United States Patent [19]

Nakagawa et al.

[11] Patent Number: 5,043,254

[45] Date of Patent: Aug. 27, 1991

[54] IMAGE FORMING METHOD

[75] Inventors: Hajime Nakagawa; Yasuhiro Yoshioka; Takatoshi Ishikawa; Genichi Furusawa; Nobutaka Ohki, all of Minami-ashigara, Japan

[73] Assignee: Fuji Photo Film Co., Ltd., Minami-ashigara, Japan

[21] Appl. No.: 440,865

[22] Filed: Nov. 24, 1989

[30] Foreign Application Priority Data

Nov. 25, 1988 [JP] Japan ..... 63-297353

[51] Int. Cl.[5] ..... G03C 7/00

[52] U.S. Cl. ..... 430/405; 430/380; 430/484; 430/505; 430/566

[58] Field of Search ..... 430/405, 380, 566, 505, 430/484

[56] References Cited

U.S. PATENT DOCUMENTS 4,066,456 1/1978 Waxman et al. ..... 430/380
4,297,437 10/1981 Kaneko et al. ..... 430/376
4,409,321 10/1983 Onodera et al. ..... 430/405
4,465,762 8/1984 Ishikawa et al. ..... 430/376
4,473,635 9/1984 Ishikawa et al. ..... 430/405

*Primary Examiner*—Charles L. Bowers, Jr.
*Assistant Examiner*—Thorl Chea
*Attorney, Agent, or Firm*—Burns, Doane, Swecker & Mathis

[57] ABSTRACT

A method for forming an image comprises processing a silver halide color photosensitive material comprising a nondiffusible coupler and a nondiffusible color developing agent on a support with a color developer containing a diffusible color developing agent comprising an aromatic primary amine. By this method, it is possible to reduce the processing time required when a color developer containing an ordinary aromatic primary amine as the color developing agent is used and also to provide a stable image forming method having only a slight processing dependence.

12 Claims, No Drawings

IMAGE FORMING METHOD

BACKGROUND OF THE INVENTION

The present invention relates to a method of developing a photosensitive (photographic) material comprising a layer containing a nondiffusible coupler and a nondiffusible color developing agent with a color developer containing a color developing agent comprising an aromatic primary amine, and thereby a dye image can be rapidly and stably formed.

An ordinary method of forming an image with a silver halide color photosensitive material comprises processing the silver halide photosensitive material with a color developer containing a color developing agent comprising an aromatic primary amine in the presence of a color coupler capable of reacting with an oxidation product of the developing agent to form a dye. Thus an azomethine dye or indoaniline dye is formed. This color developing method was first invented by L. D. Mannes & L. Godowsky in 1935. After improvement in various ways, this method is now employed through the world.

The method of processing the color photosensitive material basically comprises the following three steps:

(1) color developing step, (2) bleaching step, and (3) fixing step.

The bleaching and fixing can be conducted simultaneously in a bleach-fixing step (so-called blix step). In this step, developed silver and non-developed silver halide are removed by desilverization. In fact, the developing process includes various auxiliary steps to maintain the photographic and physical qualities of the image and to improve the shelf stability of the image, in addition of the two basic steps, i.e. color developing step and desilverization step. Baths usable in this process include, for example, a hardening bath for preventing an excess softening of the photosensitive layer in the course of the process, stop bath for effectively stopping the developing reaction, an image-stabilizing bath for stabilizing the image and a bath for removing a packing layer from the support.

A color developer used in the color developing step is a solution of a color developing agent comprising an aromatic primary amine in an aqueous alkali solution. The aromatic primary amine color developing agent penetrates into the photosensitive layer to develop (or, in other words, to reduce) the exposed silver halide. On the contrary, the developing agent is oxidized by the silver halide to form an oxidation product. The oxidized developing agent is diffused in the gelatin layer and coupled with a coupler previously dispersed therein by an oil protecting method to form a dye.

The order to prevent environmental pollution, a color developer that is free from benzyl alcohol is used mainly nowadays. However, when the benzyl alcohol-free color developer is used, the sensitivity is reduced and the maximum color density ($D_{max}$) is also reduced. Further for obtaining a photosensitive material which yields an image of a high quality and a high sharpness, the thickness of the emulsion layer is reduced to reduce fuzziness by light scattering. In one of the techniques of this method, the ratio of an oil in which the coupler is dispersed to the coupler is lowered. When the ratio of the oil to the coupler is lowered, $D_{max}$ is reduced as in the case of using benzyl alcohol-free solution.

In one known method for solving the problem that the developing activity is reduced and thus so is the rapidness, the pH of the color developer is increased and the processing temperature is elevated to accelerate the development. However, this method has serious problems in that fogging is serious, the developer becomes unstable and the photographic properties become variable in continuous processing. Another proposed method comprises using various development accelerators, but the acceleration effect of these is not yet satisfactory.

Through their studies, the inventors have found that a color developing agent is distributed into the oil which disperses the coupler in the gelatin layer and that the amount of the distributed color developing agent varies depending on the kind of the coupler and the dielectric constant of the oil. The inventors have found also that as the amount of the color developing agent distributed into the oil is increased, the color development rate of the sensitive material is increased. Namely, the higher the density of the color developing agent in the oil, the higher the dye forming rate of the material. After further investigations, the inventors have found that the dye forming rate is effectively increased by adding a nondiffusible color developing agent to the oil beforehand.

On the basis of these findings, the inventors have succeeded in formulating a photosensitive material which makes it possible to rapidly form dye with only a slight processing dependence in the development with a color developer. Namely, the photosensitive material contains a nondiffusible color developing agent together with a coupler.

Many methods are known for developing a photosensitive material containing a color developing agent with an aqueous alkali solution.

For example, U.S. Pat. No. 3,342,599 discloses the use of a Schiff base with salicyl aldehyde as a precursor of the developing agent. U.S. Pat. No. 3,719,492 discloses the use of a metal salt such as lead or cadmium salt. British Patent No. 1,069,061 discloses a precursor of a phthalimide type prepared by reacting an aromatic primary amine with phthalic acid. Japanese Patent Application No. 52-26756 discloses the use of a combination of an aromatic primary amine with a cyclic $\beta$-dicarbonyl compound. Japanese Patent Application No. 52-50909 discloses the use of a precursor prepared by bonding an aromatic primary amine with a substitued or unsubstitued (2-benzenesulfonyl)ethoxycarbonyl. Other methods are disclosed in, for example, German Patent Nos. 1,159,758 and 1,200,675, U.S. Pat. No. 3,705,035Japanese Patent Unexamined Published Application (hereinafter referred to as 'J. P. KOKAI') Nos. 57-14838 and 57-14839, and Japanese Patent Publication for Opposition Purpose (hereinafter referred to as 'J. P. KOKOKU') Nos. 63-16730 and 63-18732.

For developing a silver halide color photosensitive material containing the color developing agent or its precursor, there is used an alkaline aqueous solution having a pH higher than that of a conventional developer in order to decompose the precursor into the color developing agent and to increase the velocity of the reduction of a silver halide into metallic silver as compared with the velosity of the dissolution of the color developing agent or its precursor in the alkaline aqueous solution. The most suitable pH, which varies depending on the combination of the color coupler and the color developing agent or its precursor, is usually in the range of about 10 to 14, preferably 11 to 13.

However, when the alkaline aqueous solution having such a high pH is used for the processing, its pH is lowered by, for example, carbon dioxide in the air or hydrogen ions produced in the photosensitive material as the color development proceeds. Thus it is quite difficult to stably keep such a high pH of the alkaline aqueous solution. When the pH of the alkaline processing solution is lowered, the development rate of the photosensitive material is seriously reduced and, particularly in the continuous process, the quality of the finished product is not uniform and the maximum color density is reduced.

When the photosensitive material contains a precursor of the color developing agent, the precursor must be first activated with an alkaline aqueous solution. Therefore, it takes a long time for the color development. This is disadvantageous from the viewpoint of acceleration of the process.

Because of these problems, the photosensitive material containing the color developing agent or its precursor has not yet come into practical use.

The present invention is characterized in that a photosensitive material containing a nondiffusible coupler and a nondiffusible color developing agent is processed with a color developer containing an ordinary color developing agent comprising an aromatic primary amine. Therefore, the pH of the developer can be within an ordinary pH range (9 to 12) and it has no problem regarding stability. Further since the nondiffusible color developing agent is directly contained in the photosensitive material in the present invention, the step of the activation of the precursor of the color developing agent as described above is unnecessary. This is advantageous from the viewpoint of rapid processing.

U.S. Pat. No. 4,297,437 discloses an invention wherein a photosensitive material containing a developing agent and/or its precursor is continuously color-developed while a color developing replenisher containing a color developing agent is fed in such a manner that the amount of the color developing agent replenished is minimized. In this invention, the color developing agent contained in the photosensitive material must be diffusible, since it must be diffused into the developer so as to replenish the color developing agent in the developer.

On the contrary, the color developing agent contained in the photosensitive material of the present invention is preferably not diffused into the processing solution. When a diffusible color developing agent which diffuses into the solution is used, problems such as reduction of the maximum color density, increase of variation of the photographic properties in the cource of continuous processing and reduction of the stability of the developer arise. Therefore, the present invention is completed by incorporating a nondiffusible color developing agent which does not diffuse into the developer in the developing step in an oil containing a nondiffusible coupler.

J. P. KOKAI Nos. 62-178962 and 62-178963 disclose a photosensitive material having excellent fastness to light by incorporating a p-phenylenediamine compound therein together with a cyan coupler. However, an unsubstituted amino group is not required of the p-phenylenediamine compounds used in these inventions, since they are used as a photo-fading inhibitor for the cyan coupler. Namely, it is not required of them to exhibit the coupling activity upon oxidation.

On the other hand, the nondiffusible color developing agent is contained in the oil together with the nondiffusible coupler so as to accelerate the color development, and its oxidation product must have a coupling activity with the coupler in the present invention. Thus the above-described two inventions are utterly different from the present invention.

SUMMARY OF THE INVENTION

Therefore, it is a primary object of the present invention to reduce the processing time required when a color developer containing an ordinary aromatic primary amine as the color developing agent is used and to provide a stable image forming method having only a slight processing dependence.

Other objects of the present invention will be clear from the following description and Examples The objects of the present invention are attained by an image-forming method characterized in that a silver halide color photosensitive material comprising a nondiffusible coupler and a nondiffusible color developing agent on a support is processed with a color developer containing a diffusible color developing agent comprising an aromatic primary amine.

Unexpectedly, it is found that the color development is remarkably accelerated by incorporating a nondiffusible color developing agent together with a coupler in the photosensitive material in the image formation with a color developer containing a diffusible color developing agent.

The present invention is basically different from the invention of the above-described U.S. Pat. No. 4,297,437 in that the diffusion of the color developing agent from the material into the developer is inhibited in the present invention, while the diffusion thereof is intended in the latter.

DESCRIPTION OF THE PREFERRED EMBODIMENTS

As the nondiffusible color developing agent usable in the present invention, those comprising an aromatic primary amine of the following general formula [I] are preferred:

General formula [I]:

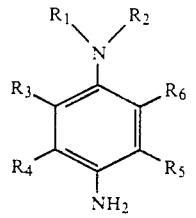

$R_1$ and $R_2$ in the above general formula [I] each represent a hydrogen atom, a straight chain or branched alkyl group, a cycloalkyl group or a straight chain or branched alkenyl group, or $R_1$ and $R_2$ may form a heterocyclic group together with the nitrogen atom. The alkyl group, alkenyl group and cycloalkyl groups may have a substituent. The substituents are, for example, aryl groups, cyano group, halogen atoms, heterocyclic groups, alkyl groups, alkenyl groups, cycloalkyl groups, groups bonded through a carbonyl group (such as acyl, carboxyl, carbamoyl, alkoxycarbonyl and aryloxycarbonyl groups), and groups bonded through a hetero atom [such as those bonded through an oxygen atom (e.g. hydroxy, alkoxy, aryloxy, heterocyclic oxy, acyloxy and carbamoyloxy groups), those bonded through a nitrogen atom (e.g. nitro, amino (including dialkylamino), sulfamoylamino, alkoxycarbonylamino, aryloxycarbonylamino, acylamino, sulfonamido, imido and ureido groups), those bonded through a sulfur atom (e.g. alkylthio, arylthio, heterocyclic thio, sulfonyl, sulfinyl and sulfamoyl groups) and those bonded through a phosphorus atom (e.g. phosphonyl group)].

They include, for example, methyl group, ethyl group, isopropyl group, t-butyl group, pentadecyl group, heptadecyl group, 1-hexylnonyl group, 1,1'-dipentylnonyl group, 2-chloro-t-butyl group, trifluoromethyl group, 1-ethoxytridecyl group, 1-methoxyisopropyl group, methanesulfonylethyl group, 2,4-di-t-amylphenoxymethyl group, anilino group, 1-phenylisopropyl group, 3-n-butanesulfonaminophenoxypropyl group, 3-4'-{α-[4''(p-hydroxybenzenesulfonyl)phenoxy]dodecanoylamino} phenylpropyl group, 3-{4'-[α-(2'',4''-di-t-amylphenoxy)butaneamido]phenyl}—propyl group, 4-[α-(o-chlorophenoxy)tetradecaneamidophenoxy]propyl group, allyl group, propenyl group, decenyl group, cyclopentyl group and cyclohexyl group.

$R_3$, $R_4$, $R_5$ and $R_6$ are substituents of the benzene ring and are not particularly limited. They are, for example, a hydrogen atom, halogen atom, alkyl group, alkenyl group, aryl group, alkoxy group, alkenoxy group, aryloxy group, alkylthio group, arylthio group, acyl group, acyloxy group, acylamino group, amino group, sulfonamido group, carbamoyl group, sulfamoyl group, alkoxycarbonyl group and aryloxycarbonyl group. ($R_3$ and/or $R_6$ may form a five-membered or six-membered ring together with $R_1$ and/or $R_2$.) The number of the total carbon atoms in the substituents $R_1$ to $R_6$ is 10 to 30.

The nondiffusible color developing agent of the general formula [I] contained in the photosensitive material of the present invention may be in the form of a salt with an acid capable of forming a salt with the amine such as a mineral acid (e.g. hydrochloric acid, sulfuric acid, phosphoric acid or boric acid) or an organic acid (e.g. methanesulfonic acid, p-toluenesulfonic acid or trifluoroacetic acid).

Although the compound used in the present invention may be a precursor of a color developing agent capable of releasing the nondiffusible agent of the general formula [I] in the color developer, the nondiffusible color developing agent which per se has the developing activity is preferable to the precursor in order to obtain a more excellent developing effect.

The compound of the general formula [I] of the present invention is incorporated into a high-boiling organic solvent (oil) used for dispersing the nondiffusing coupler in the photosensitive material in order to accelerate the dye-forming rate in the color developing step. Therefore, this compound preferably does not diffuse into the color developer. For this purpose, it is preferred that the number of the total carbon atoms in the substituents $R_1$, $R_2$, $R_3$, $R_4$, $R_5$ and $R_6$ is preferably 13 to 30. The compounds satisfying this condition hardly diffuse from the photosensitive material into the developer during the color development step. Further they have an increased solubility in an oil and, therefore, they are hardly influenced by aqueous solutions and have an increased resistance to hydrolysis.

Examples of the nondiffusible color developing agents usable in the present invention will be given below, which by no means limit the invention:

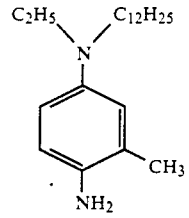
(1)

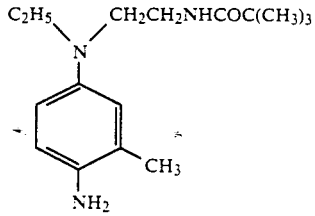
(2)

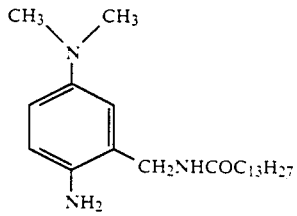
(3)

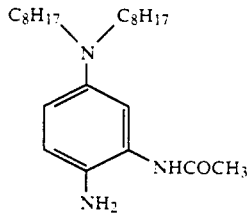
(4)

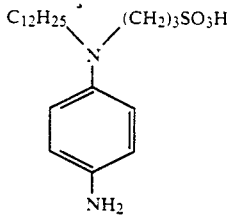
(5)

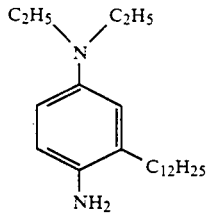
(6)

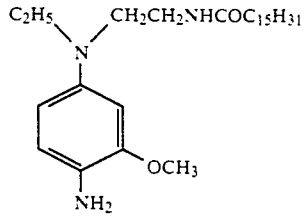
(7)

-continued
(8)
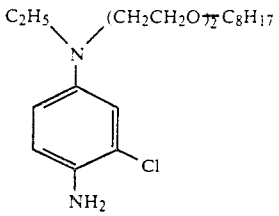
(9)
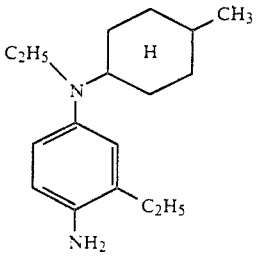
(10)
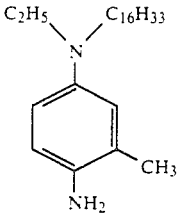
(11)
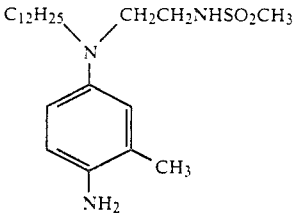
(12)
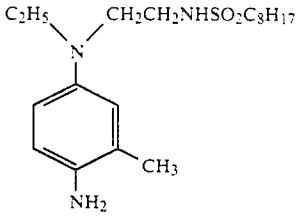
(13)
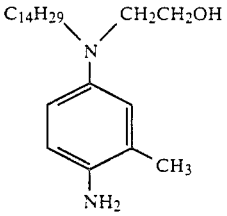
(14)
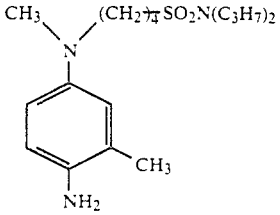
-continued
(15)
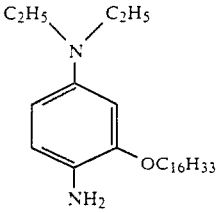
(16)
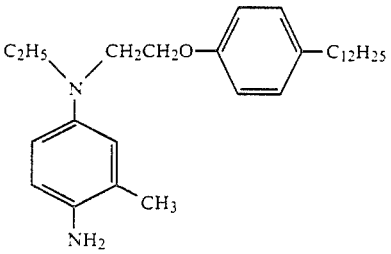
(17)
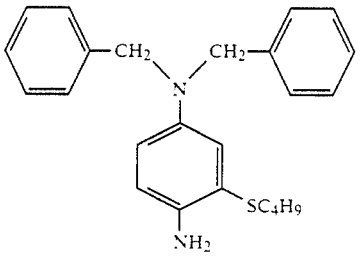
(18)
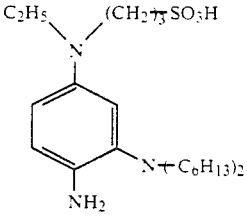
(19)
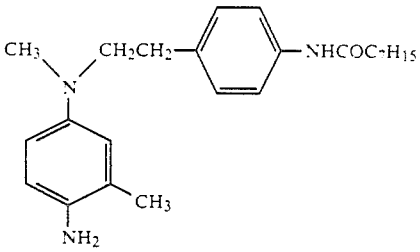
(20)
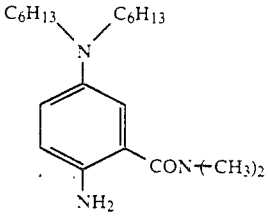
(21)
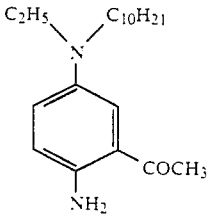

-continued (22)

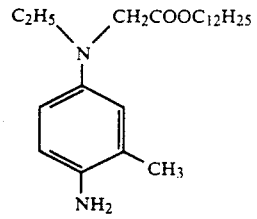

(23)

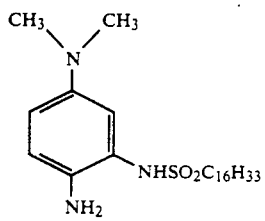

(24)

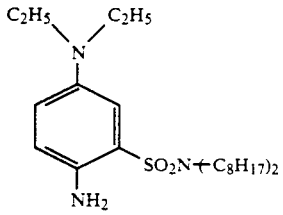

(25)

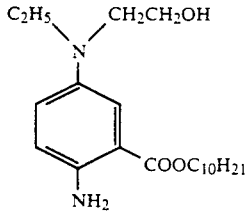

(26)

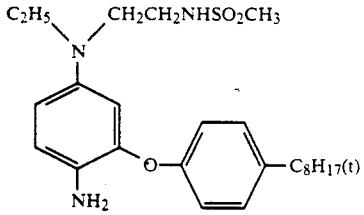

(27)

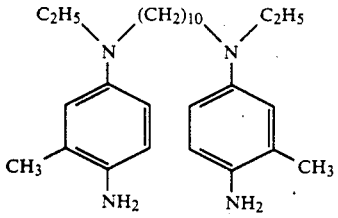

(28)

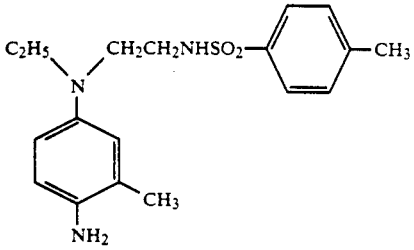

-continued (29)

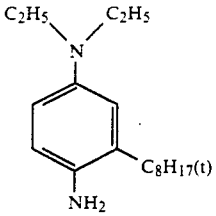

(30)

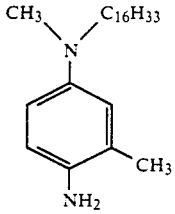

The developing agent to be incorporated into the photosensitive material of the present invention can be produced by a known method or a method derived from a known method. For example, U.S. Pat. No. 3,705,035 discloses a nondiffusible developing agent and an example of producing the compound (5) of the present invention. Further examples of the production of typical color developing agents are described in U.S. Pat. Nos. 2,548,574, 2,566,271, 2,592,363 and 2,592,364. The compounds of the present invention can be produced by these methods.

The amount of the nondiffusible color developing agent of the general formula [I] used in the present invention is preferably 5 to 200 molar %, particularly 5 to 100 molar %, based on the nondiffusible coupler contained in the same layer.

In this connection, it is preferable that the nondiffusible color developing agent be incorporated into each of the emulsion layer containing the nondiffusible color coupler.

The compound of the general formula [I] is dispersed in a hydrophilic colloidal solution usually together with the nondiffusible coupler by an oil/water emulsion-forming dispersion method. The effect of the present invention is improved by thus using the oil. Particularly when the compound is incorporated in the oil phase containing the nondiffusible coupler, the remarkable effect is obtained. On the other hand, the compound can also be dispersed in a hydrophilic binder without using the oil. The oil used in the oil/water emulsion-forming dispersion method, i.e. high-boiling organic solvent, is preferably an oil in which the coupler used in the oil-protection type photosensitive material is soluble. Such preferred oils are high-boiling organic solvents represented by the following general formulae (A), (B), (C), (D) and (E). Among these, those of the general formulae (A), (C), (D) and (E) are particularly preferred from the viewpoint of the acceleration of the development:

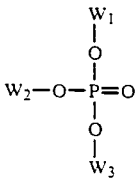

General formula (A)

General formula (B)

-continued

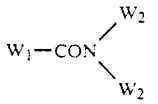

General formula (C)

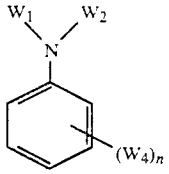

General formula (D)

$W_1—O—W_2$ General formula (E)

wherein $W_1$, $W_2$ and $W_3$ each represent a substituted or unsubstituted alkyl group, cycloalkyl group, alkenyl group, aryl group or heterocyclic group, $W_4$ represents $W_1$, $OW_1$ or S-$W_1$, n represents an integer of 1 to 5, when n is 2 or more, the $W_4$'s may be the same or different from one another, and $W_1$ and $W_2$ in the general formula (E) may form together a condensed ring.

The number of the total carbon atoms of the substituents $W_1$, $W_2$, $W_3$ and/or $W_4$ in the high-boiling organic solvents of the general formulae (A), (B), (C), (D) and (E) is at least about 8 and the dielectric constant thereof is at least 4.00 (25° C.). The dielectric constant can be easily determined by a bridge method using a transformer (TRS-10T; a product of Ando Denki Co.).

When $W_1$, $W_2$ or $W_3$ in the general formulae (A), (B), (C) or (E) has a substituent, the substituent may have one or more bonding groups selected from the group consisting of

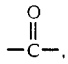

—COO<, —$R^8$N<($R^8$ being a divalent to hexavalent group formed by removing a hydrogen atom from phenyl group) and —o—.

The alkyl groups represented by $W_1$, $W_2$, $W_3$ or $W_4$ in the general formulae (A), (B), (C), (D) or (E) may be either straight chain or branched. They include, for example, methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl and eicosyl groups.

The substituents of the alkyl groups of, for example, the compounds of the above general formula (A) are, for example, halogen atoms, cycloalkyl groups, aryl groups and ester groups. The substituted alkyl groups include, for example, halogen (F, Cl or Br)—substituted alkyl groups (e.g. —$C_2HF_4$, —$C_5H_3f_8$, —$C_9H_3F_{16}$, —$C_2H_4Cl$, —$C_3H_6Cl$, —$C_3H_5Cl_2$, —$C_3H_5ClBr$ and —$C_3H_5Br_2$), cycloalkyl-substituted alkyl groups

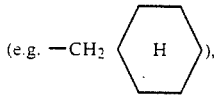

aryl-substituted alkyl groups

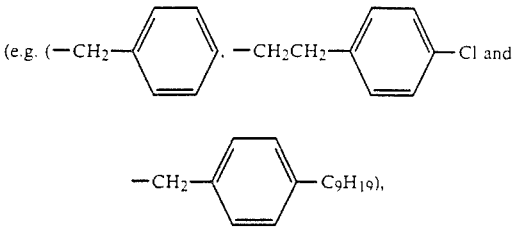

alkyl groups forming a dibacic acid ester

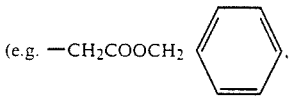

—$CH_2CH_2COOC_{12}H_{25}$, —$(CH_2)_4COOCH_2(CF_2)_4H$—$(CH_2)_7COOC_4H_9$ and —$(CH_2)_8COOC_4H_9$), alkyl groups forming a lactic acid ester (e.g.

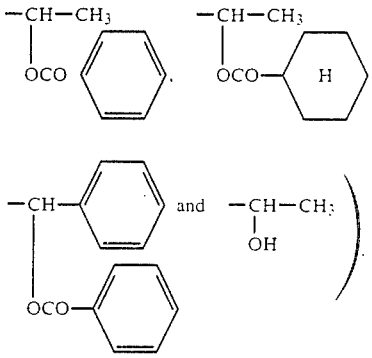

alkyl groups forming a citric acid ester (e.g.

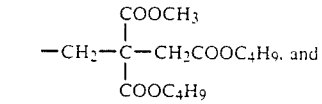

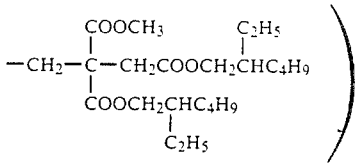

alkyl esters forming a malic acid ester (e.g. —$CH_2CH(OH)$—$COOC_6H_{13}$), alkyl esters forming a tartaric acid ester (e.g.

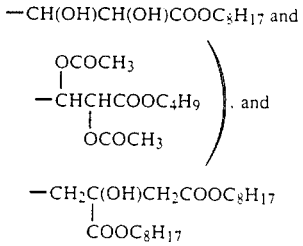

The alkyl groups of the general formulae (B) to (E) may be substituted with the same substituents described above for the general formula (A).

$R^3$ and $R^4$ in the general formula (E) may form a condensed ring such as oxirane ring oxorane ring, or oxane ring.

The cycloalkyl groups represented by $W_1$, $W_2$, $W_3$ or $W_4$ are, for example,

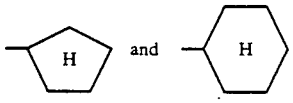

and the substituted cyclohexyl groups are, for example,

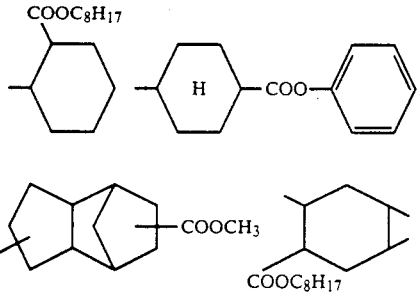

The aryl groups represented by $W_1$, $W_2$, $W_3$ or $W_4$ are, for example,

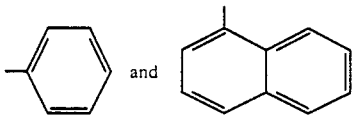

and the substituted aryl groups are, for example, phthalic, isophthalic, terephthalic and trimellitic esters of the following formulae:

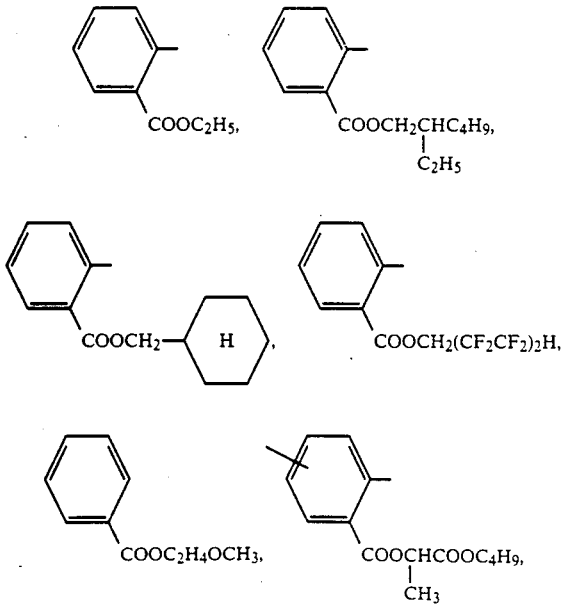

-continued

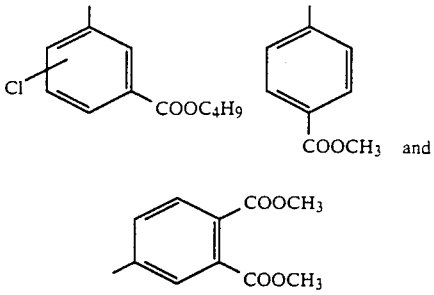

and substituted benzoic esters of the following formulae:

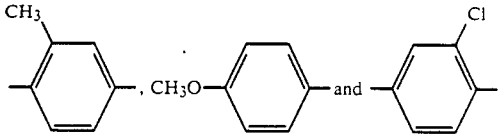

The alkenyl groups are, for example, $-C_4H_7$, $-C_5H_9$, $-C_6H_{11}$, $-C_7H_{13}$, $-C_8H_{15}$, $-C_{10}H_{19}$, $-C_{12}H_{23}$ and $C_{18}H_{35}$. The substituted alkenyl groups are those substituted with a halogen atom (F, Cl or Br), $-OC_8H_{17}$, $-OC_{12}H_{25}$,

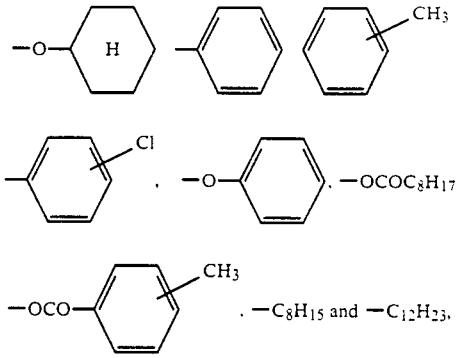

and those of the formula: $-CH=CH-COOCH_2CHC_4H_9$ and

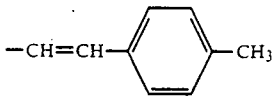

The high-boiling organic solvents substituted with $W_1$, $W_2$, $W_3$ or $W_4$ preferably have a dielectric constant of at least 5.0 at 25° C. and a viscosity of at least 20 cP at 25° C. It is surprising that the coloring property can be improved without impairing the absorption of the dye or other properties by adjusting the dielectric constant and viscosity in these ranges. Although the mechanism of this phenomenon is yet unknown, supposedly the high-boiling organic solvents having a high dielectric constant have a high uptake of the color developing agent and when the high-boiling organic solvents having a medium viscosity are used, the bad influence of the coupler in the oil drops on the silver halide is mitigated.

The amount of the high-boiling solvent represented by the general formula (A), (B), (C), (D) or (E) is not particularly limited and is variable depending on the kind and the amount of the coupler used. Preferably the weight ratio of the high-boiling organic solvent to the coupler is in the range of 0.05 to 20. The high-boiling solvents of the present invention represented by the general formula (A), (B), (C), (D) or (E) can be used singly or in combinations of one or more or with other known high-boiling organic solvents so far as the object of the present invention can be attained. The known high-boiling organic solvents include, for example, phosphate solvents such as tricresyl phosphate, tri-2-ethylhexyl phosphate, 7-methyloctyl phosphate and tricyclohexyl phosphate; and phenol solvents such as 2,5-di-tert-amylphenol and 2,5-di-sec-amylphenol.

Examples of the high-boiling organic solvents represented by the general formulae (A), (B), (C), (D) and (E) will be given below, which by no means limit the solvents.

$O{=}P(OC_4H_{9}\text{-}n)_3$ (S-1)

$O{=}P(OCH_2CH_2CH(CH_3)_3)_3$ (S-2)

$O{=}P(OC_6H_{13}\text{-}n)_3$ (S-3)

(S-4)

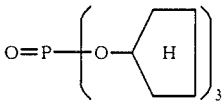

(S-5)

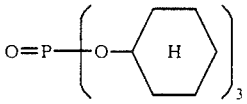

$O{=}P(OC_8H_{17}\text{-}n)_3$ (S-6)

(S-7)

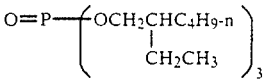

(S-8)

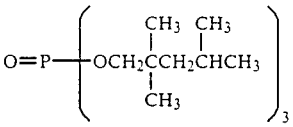

(S-9)

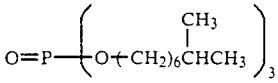

$O{=}P(OC_9H_{19}\text{-iso})_3$ (S-10)

(S-11)

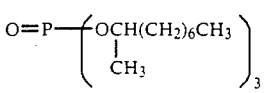

$O{=}P(OC_{10}H_{21}\text{-}n)_3$ (S-12)

(S-13)

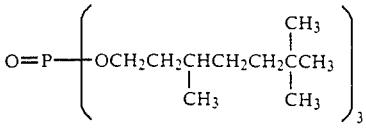

-continued

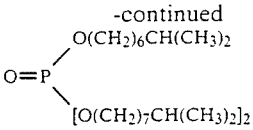

(S-14)

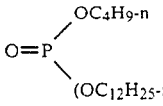

(S-15)

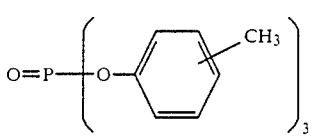

(S-16)

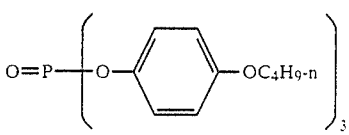

(S-17)

(S-18)

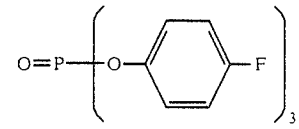

(S-19)

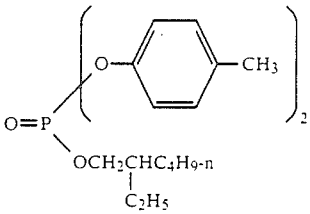

(S-20)

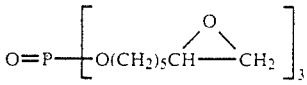

(S-21)

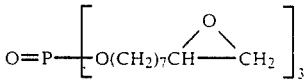

(S-22)

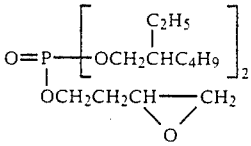

(S-23)

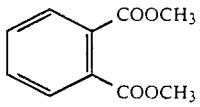

(S-24)

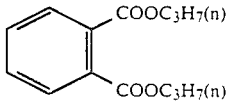

(S-25)

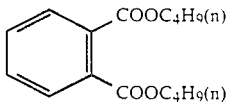

-continued
(S-26)
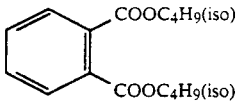
(S-27)
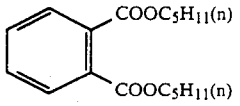
(S-28)
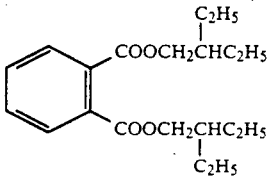
(S-29)
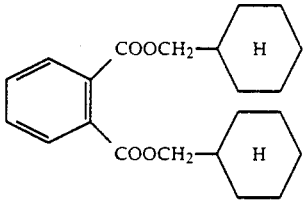
(S-30)
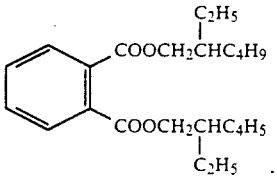
(S-31)
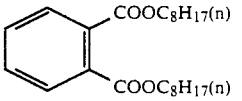
(S-32)
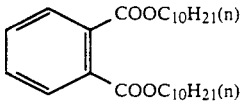
(S-33)
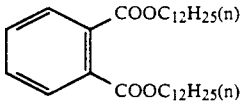
(S-34)
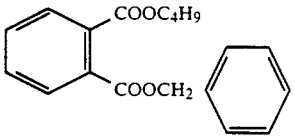
(S-35)
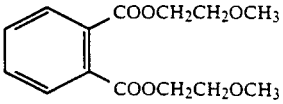
(S-36)
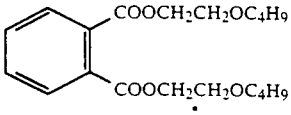
-continued
(S-37)
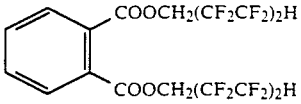
(S-38)
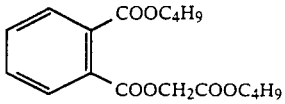
(S-39)
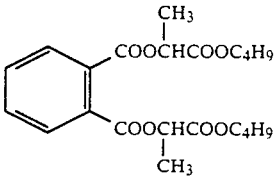
(S-40)
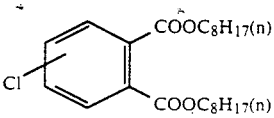
(S-41)
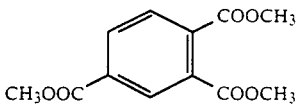
(S-42)
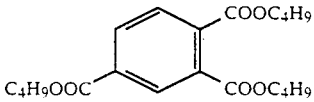
(S-43)
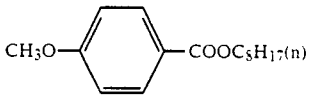
(S-44)
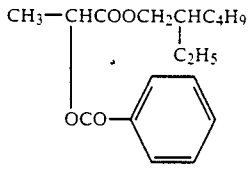
(S-45)
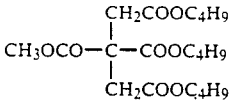
(S-46)
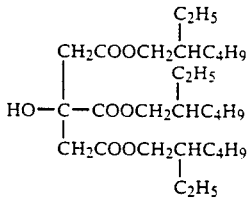
(S-47)
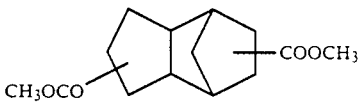
(S-48)
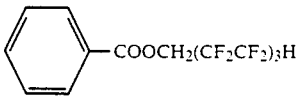

-continued (S-49) $CHCOOCH_2(CF_2CF_2)_2H$ ‖ $CHCOOCH_2(CF_2CF_2)_2H$ (S-50) 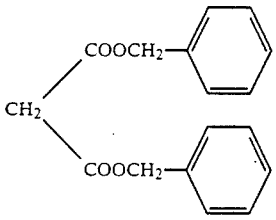

(S-51) 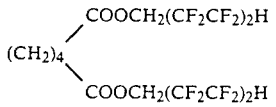

(S-52) 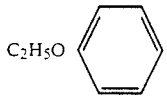

(S-53) 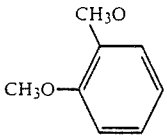

(S-54) 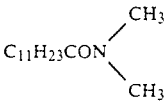

(S-55) 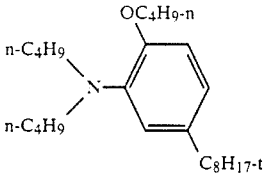

(S-56) 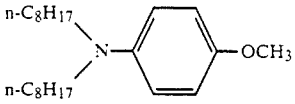

An ordinary surfactant is used in dispersing the nondiffusible coupler and the nondiffusible color developing agent of the general formula [I] in water with the above-described high-boiling organic solvent by the oil/water emulsion-forming dispersion method. The surfctants include anionic surfactants having an acid group such as a carboxylic acid group, sulfonic acid group, phosphoric acid group, sulfuric ester group or phosphoric ester group, nonionic surfactants, cationic surfactants and ampholytic surfactants.

The hydrophilic colloids usable herein are those known as photographic binders such as gelatin. Various synthetic hydrophilic homopolymers and copolymers can be used. They include, for example, gelatin derivatives, graft polymers of gelatin with other polymers, cellulose derivatives such as hydroxyethyl cellulose, carboxymethyl cellulose and cellulose sulfate, sodium alginate, starch derivatives, partial acetal of polyvinyl alcohol, poly-N-vinylpyrrolidone, polyacrylic acid, polymethacrylic acid, polyacrylamide, polyvinylimidazole and polyvinylpyrazole. A latex can be added thereto. Examples include compounds described in U.S. Pat. No. 3,518,088.

The color developer used for the development of the photosensitive material of the present invention is preferably an alkaline aqueous solution containing the diffusible aromatic primary amine color developing agent as the main component. The diffusible color developing agents are those of the above general formula (I) wherein the number of total carbon atoms contained in the substituents $R_1$, $R_2$, $R_3$, $R_4$, $R_5$ and $R_6$ is 9 or less (including 0), preferably 3 to 8 and more preferably 3 to 7. Although aminophenol compounds are usable as the color developing agent, p-phenylenediamine compounds are preferred. Typical examples include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline and their sulfates, hydrochlorides and p-toluenesulfonates. They can be used either singly or in combinations of two or more. The amount of the diffusible color developing agent contained in the color developer may be 0.3 m mol/l to 0.06 mol/l, preferably 1.5 m mol/l to 0.05 mol/l.

The color developer usually contains a pH buffering agent such as an alkali metal carbonate, borate or phosphate and a development inhibitor or antifoggant such as a bromide, iodide, benzimidazole, benzothiazol or mercapto compound. If necessary, the color developer can contain preservatives such as hydroxylamine, diethylhydroxylamine, hydrazine sulfites, phenylsemicarbazides, triethanolamine, catecholsulfonic acid salts and triethylenediamine (1,4-diazabicyclo[2,2,2]octane); organic solvents such as ethylene glycol and diethylene glycol; development accelerators such as polyethylene glycol, quaternary ammonium salts and amines; color-forming couplers; competing couplers and fogging agents such as sodium boron hydride; assistant developing agents such as 1-phenyl-3-pyrazolidone; thickening agents; chelating agents such as aminopolycarboxylic acids, aminopolyphosphonic acids, alkylphosphonic acids and p hosphonocarboxylic acids [e.g. ethylenediaminetetraacetic acid, nitrilotriacetic acid, diethylenetriaminepentaacetic acid, cyclohexanediaminetetraacetic acid, hydroxyethyliminediacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts thereof]. The color developer is preferably substantially free from benzyl alcohol. Namely, the benzyl alcohol content of the color developer is preferably 5 ml/l or less and more preferably 0 ml/l. The effect of the nondiffusible color developing agent in the photosensitive material is more excellent when the developer is free from benzyl alcohol than that obtained when benzyl alcohol or the like is contained in the color developer.

The color developer usually has a pH of 9 to 12. The amount of the developer to be replenished varies depending on the color photosensitive material to be processed and is usually 3 l or less per square meter of the material. It can be reduced to 500 ml or less by reducing the bromide ion concentration in the replenisher. When the amount of the replenisher is reduced, it is preferred to inhibit the evaporation of the developer and oxidation thereof by air by reducing the contact area of the processing tank with air. The amount of the replenisher can be reduced by inhibiting the accumulation of the bromide ion in the developer.

After the color development, the photographic emulsion layer is usually bleached. The bleaching may be conducted simultaneously with fixing (bleach-fixing) or separately from the latter. To accelerate the process, the bleaching processing can be followed by bleach-fixing processing. Depending on the purpose, two bleach-fixing baths connected together can be used, fixing can be conducted prior to the bleach-fixing or bleaching can be conducted after the bleach-fixing. The bleaching agents usable herein include, for example, polyvalent metal compounds such as iron (III), cobalt (III), chromium (IV) and copper (II) compounds, peroxides, quinones and nitro compounds. Typical examples of the bleaching agents include ferricyanides; dichromates; organic complex salts of iron (III) or cobalt (III) such as complexes thereof with aminopolycarboxylic acids, e.g. ethylenediaminetetraacetic acid, diethylenetriaminepentaacetic acid, cyclohexanediaminetetraacetic acid, methyliminodiacetic acid, 1,3-diaminopropanetetraacetic acid and glycol etherdiaminetetraacetic acid as well as those with citric acid, tartaric acid and malic acid; persulfates; bromates; permanganates; and nitrobenzenes. Among these, the iron (III)/aminopolycarboxylic acid complex salts such as iron (III)/ethylenediaminetetraacetatic acid complex salt and persulfates are preferred from the viewpoint of rapid processing and prevention of environmental pollution. The iron (III)/aminopolycarboxylic acid complex salts are particularly effective in both the bleaching solution and bleach-fixing solution. The bleaching solution or bleach-fixing solution containing the iron (III)-/aminopolycarboxylic acid complex salt has a pH of usually 5.5 to 8. A bleach-fixing solution having a lower pH is also usable for acceleration of the processing.

If necessary, a bleaching accelerator can be incorporated into the bleaching solution, bleach-fixing solution or pre-processing bath. The bleaching accelerators usable herein are compounds having a mercapto group or disulfide group described in U.S. Pat. No. 3,983,858 and Research Disclosure No. 17, 129 (July, 1978); thiazolidine derivatives described in J. P. KOKAI NO. 50-140, 129; thiourea derivatives described in J. P. KOKOKU No. 45-8,506, J. P. KOKAI Nos. 52-20,832 and 53-32,735 and U.S. Pat. No. 3,706,561; iodide salts described in West German Patent No. 1,127,715 and J. P. KOKAI No. 58-16,235; polyoxyethylene compounds described in West German Patent Nos. 966,410 and 2,748,430; polyamine compounds described in J. P. KOKOKU No. 45-8836; compounds described in J. P. KOKAI Nos. 49-42,434, 49-59,644, 53-94,927, 54-35,727, 55-26,506 and 58-163,940; and bromide ion. Among these, the compounds having mercapto group or disulfide group are preferred, since they have a high accelerating effect. Compounds described in U.S. Pat. No. 3,893,858, West German Patent No. 1,290,812 and J. P. KOKAI NO. 53-95,630 are particularly preferred. The most preferred are the compounds described in U.S. Pat. No. 4,552,834. The bleach-fixing agent can be incorporated into the photosensitive material. These bleach-fixing agents are particularly effective in the bleach-fixing of a photographic color photosensitive material.

The fixing agents include thiosulfates, thiocyanates, thioether compounds, thioureas and a large amount of iodide salts. Among these, the thiosulfates are usually used and particularly ammonium thiosulfate is most widely usable. The preservatives for the bleach-fixing solution are preferably sulfites, bisulfites, sulfinic acids and carbonylbisulfite adducts.

After the desilverization, the silver halide color photosensitive material of the present invention is usually washed with water and/or stabilized. The amount of water used in the washing step is variable over a wide range depending on the properties of the photosensitive material (depending on the components used such as the coupler), use, temperature of water, number of the washing tanks (number of stages), manner of the flow (counter current or parallel current), etc. The relationship between the number of the tanks for washing and the amount of water in a multistage counter current process can be determined by the method described in Journal of the Society of Motion Picture and Television Engineers, Vo. 64, pp. 248 to 253 (May, 1955).

According to the multistage counter current process described in the above literature, the amount of water for washing can be remarkably reduced, but the process has problems in that since the residence time of water in the tank is prolonged, bacteria are propagated and the suspended matter thus formed adheres to the photosensitive material. In processing the color photosensitive material according to the present invention, these problems can be solved quite effectively by reducing the amount of calcium ion and magnesium ion by a method described in U.S. Ser. No. 07/057,254. Further, germicides are usable. The germicides usable herein are isothiazolone compounds, thiabendazoles and chlorine-containing germicides such as sodium chloroisocyanurate described in J. P. KOKAI NO. 57-8,542, as well as germicides such as benzotriazole described in 'Bokin Bokabizai no Kagaku' written by Hiroshi Horiguchi, 'Biseibutsu no Mekkin, Sakkin, Bokabi Gijutsu' edited by Eisei Gijutsu-kai and 'Bokin Bokabizai Jiten' edited by Nippon Bokin Bokabi Gakkai.

The pH of water used for washing the photosensitive material in the present invention is 4 to 9, preferably 5 to 8. The temperature of the water and the washing time are variable depending on the properties and the use of the photosensitive material. Usually, the material is washed with water at 15° to 45° C. for 20 sec to 10 min, preferably at 25° to 40° C. for 30 sec to 5 min. The photosensitive material of the present invention can be processed directly with a stabilizer without washing with water. In the stabilization, any of known methods described in J. P. KOKAI Nos. 57-8,543, 58-14,834 and 60-220,345 can be employed.

Alternatively, the washing step may be followed by the stabilization step. For example, a stabilizing bath containing formalin and a surfactant used as the final bath for photographic color photosensitive material can be used in this step. The stabilizing bath may contain also a chelating agent and an antifungal agent.

The solution overflowed upon the washing or the replenishment of the stabilizer can be reused in other steps such as the desilverization step.

If necessary, the silver halide color photosensitive material of the present invention may contain a 1-phenyl-3-pyrazolidone in order to accelerate the color development. Typical examples are described in J. P. KOKAI Nos. 56-64,339, 57-144,547 and 58-115,438.

The processing solutions are used at a temperature of 10° C. to 50° C. in the present invention. The temperature is usually 33° to 38° C. but a higher temperature can be employed to accelerate the processing or to shorten the processing time, or a lower temperature can be employed to improve the image quality or the stability of the processing solutions. For saving silver in the photosensitive material, it may be processed with a cobalt intensifier or hydrogen peroxide intensifier described in West German Patent No. 2,226,770 or U.S. Pat. No. 3,674,499.

The method of the present invention can be employed for processing, for example, color papers, color direct positive photosensitive materials and color negative films. Among these, the color papers are preferred.

The silver halide emulsion used for forming the photosensitive material of the present invention may have any halogen composition such as silver bromoiodide, silver bromide, silver chlorobromide or silver chloride.

In the rapid processing or processing with a small amount of the replenisher, a silver chlorobromide or silver chloride emulsion having a silver chloride content of at least 80 molar % is preferred and one having a silver chloride content of 90 to 99.9 molar % is particularly preferred. In case a high sensitivity is required and the fog during the production, storage and/or processing is to be controlled to a particularly low level, the use of a silver chlorobromide or silver bromide emulsion having a silver bromide content of at least 50 molar % is preferred and one having a silver bromide content of at least 70 molar % is particularly preferred. Although the rapid processing becomes difficult when the silver bromide content is 90 molar % or above, the development can be accelerated to some extent by using a development accelerator such as a silver halide solution, fogging agent or developer. In all cases, a high silver iodide content is undesirable and the silver iodide content is controlled to 3 molar % or below. These silver halide emulsions are preferred for use mainly in printing photosensitive materials such as color papers.

Silver bromoiodide or silver chlorobromoiodide is preferred for photographic color photosensitive materials (negative films). The silver iodide content is preferably 3 to 15 molar %.

The silver halide grains in the present invention may have a core/shell structure, polyphase structure or homogeneous phase structure. Further, a mixture of these is also usable.

The average size of the silver halide grains used in the present invention (shown in terms of the average diameter in the projections of the grains when they are spherical or almost spherical or the average length of the edge in the projection when they are cubic) (when the grains are plate-like, the average size thereof is calculated in terms of the spheres) is preferably 0.1 μm to 2 μm, particularly preferably 0.15 μm to 1.5 μm. The grain size distribution is not particularly limited. It is preferred, however, that so-called monodisperse silver halide emulsion used in the present invention has a degree of variability [(standard deviation of the grain size distribution curve of the silver halide emulsion)-/(average grain size)] of not more than 20%, particularly not more than 15%. To obtain a photosensitive material which satisfies an intended gradation, two or more monodisperse silver halide emulsions having grain sizes different from one another (the degree of variability thereof being within the above-described range) can be imcorporated into one layer or more layers having the same color sensitivity. Further two or more polydisperse silver halide emulsions can be mixed together or can be used for forming multiple layers or a combination of the monodisperse emulsion with a polydisperse emulsion can be used in the same manner.

The silver halide grains used in the present invention may have a regular crystalline form such as cubic, octahedral, rhombododecahedral or tetradecahedral form or a mixture of thereof, or an irregular crystalline form such as spherical form, or a mixture of thereof. The grains may also be tabular. Among these, an emulsion in which at least 50% of the projection area of the grains has a ratio of length to thickness of at least 5, preferably at least 8. The emulsion may have a mixture of the crystals having various crystal forms. These emulsions may be of a surface latent image-type in which the latent image is formed on the surface or of an internal latent image-type in which the latent image is formed in the grains.

The photographic emulsion used in the present invention can be prepared by a process described in Research Disclosure (RD) Vol. 176, Item No. 17643 (I, II and III) (December, 1978).

In the present invention, usually an emulsion which has been subjected to the physical aging, chemical aging and spectral sensitization is used. The additives used in these processes are disclosed in Research Disclosure, Vol. 176, No. 17643 (December, 1978) and Vol. 187, No. 18716 (November, 1979) at the locations shown in the following Table.

Known photographic additives usable in the present invention are also described in the above two numbers of Research Disclosure at the locations shown in the following Table.

| Kind of Additive | RD 17643 | RD 18716 |
|---|---|---|
| 1 Chemical sensitizing agent | Page 23 | Page 648, Right column |
| 2 Sensitivity increasing agent | " | " |
| 3 Spectral sensitizing agent | Pages 23–24 | Page 648, Right column to Page 649, Right column |
| 4 Supersensitizing agent | " | |
| 5 Brightening agent | Page 24 | |
| 6 Antifoggant and stabilizer | Pages 24–25 | Page 649, Right column |
| 7 Coupler | Page 25 | " |
| 8 Organic solvent | " | " |
| 9 Light absorber and filter dye | Pages 25–26 | " |
| 10 U.V. absorber | " | Page 649, Right column to Page 650, Left column |
| 11 Anti-staining agent | Page 25, Right column | Page 650, Left to Right column |
| 12 Color image stabilizer | Page 25 | Page 650, Left to Right column |
| 13 Hardening agent | Page 26 | Page 651, Left column |
| 14 Binder | " | " |
| 15 Plasticizer and Lubricant | Page 27 | Page 650, Right column |
| 16 Coating assistant and surfactant | Pages 26–27 | " |
| 17 Antistatic agent | Page 27 | " |

Various color couplers can be used in the present invention. The term 'color coupler' indicates a compound capable of forming a dye by a coupling reaction with an oxidation product of an aromatic primary amine developing agent. Typical examples of the useful color couplers include naphthol or phenol compounds, pyrazolone or pyrazoloazole compounds and open chain or heterocyclic ketomethylene compounds. Examples of the cyan, magenta and yellow couplers usable in the present invention are described in the patents referred to in Research Disclosure (RD) 17643 (December, 1978) VII-D and 18717 (November, 1979).

The color coupler contained in the photosensitive material is nondiffusible, since it has a ballast group or is polymerized. Silver to be applied can be saved more markedly by using a 2-equivalent color coupler substituted with a removable group than by using a 4-equivalent color coupler in which the coupling active position is hydrogen atom. A coupler which forms a suitably diffusible dye, non-coloring coupler, DIR coupler which releases a development inhibitor as the coupling reaction proceeds and coupler which releases a development accelerator are also usable.

Examples of the nondiffusible color coupler are as follows:

C-(1)

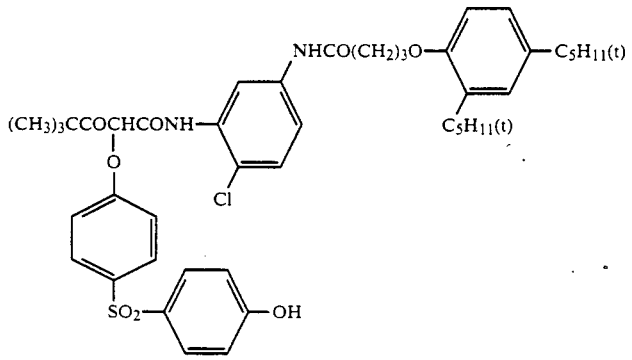

C-(2)

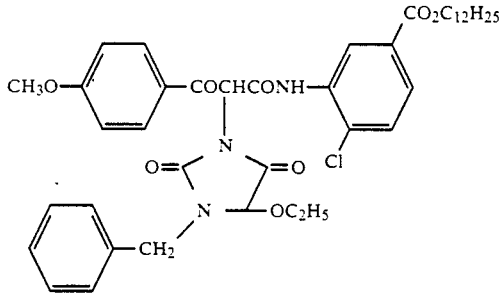

C-(3)

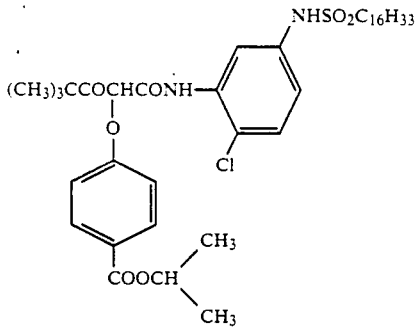

C-(4)

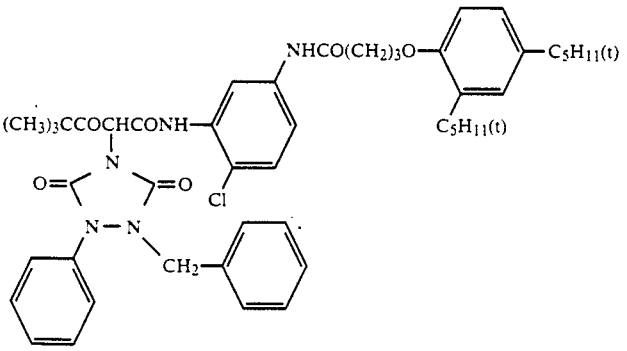

-continued
C-(5)
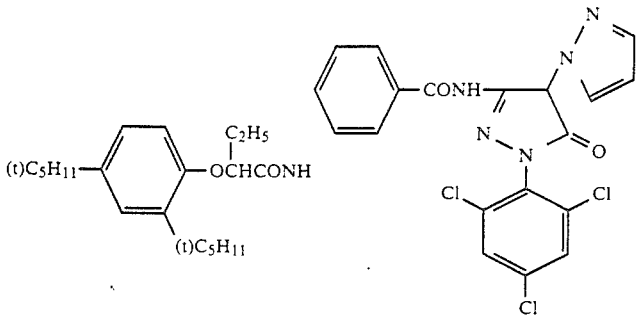
C-(6)
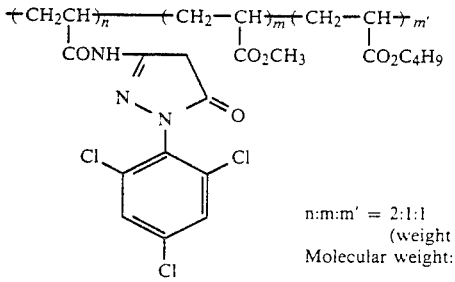
n:m:m' = 2:1:1
(weight ratio)
Molecular weight: about 40,000
C-(7)
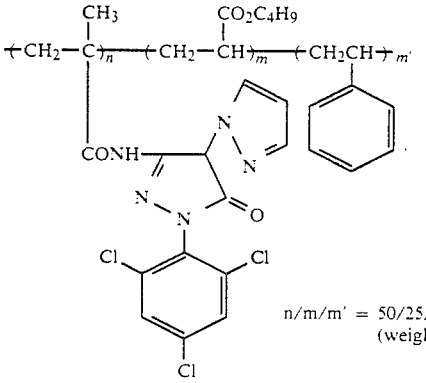
n/m/m' = 50/25/25
(weight %)
Average molecular weight: about 30,000
C-(8)
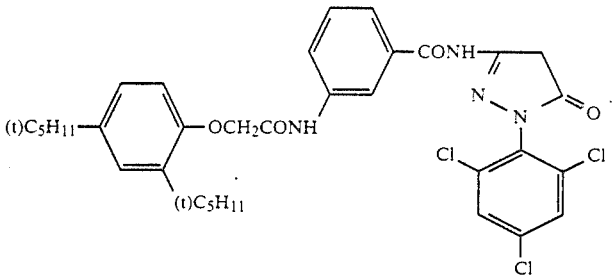
C-(9)
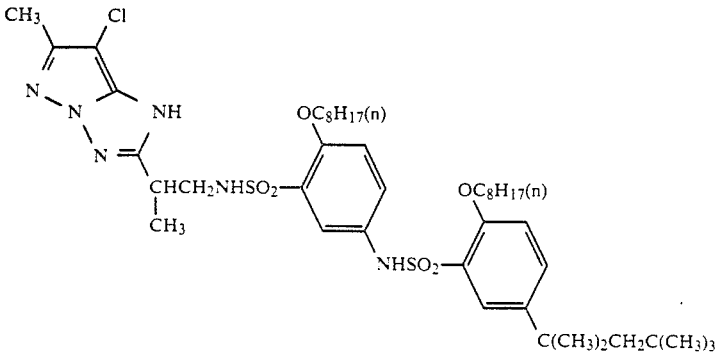

-continued
C-(10)
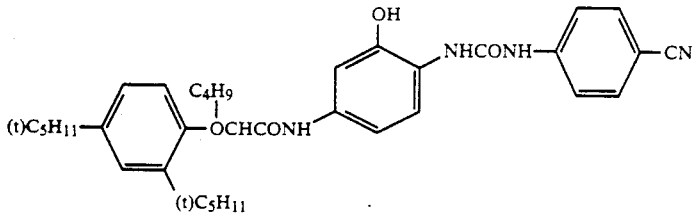
C-(11)
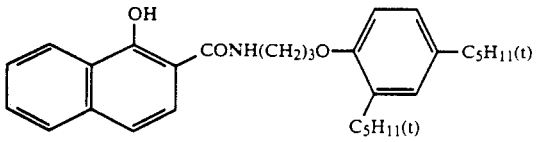
C-(12)
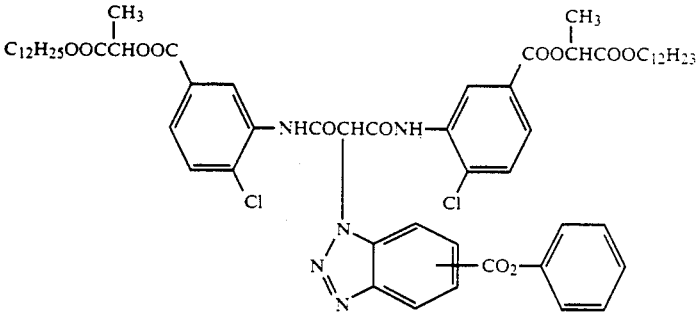
C-(13)
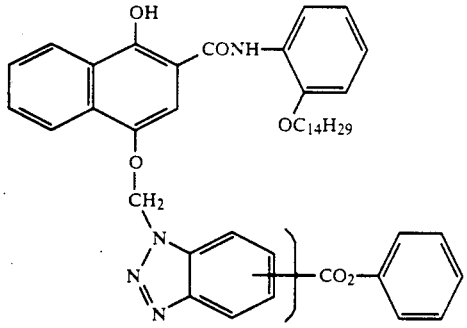
C-(14)
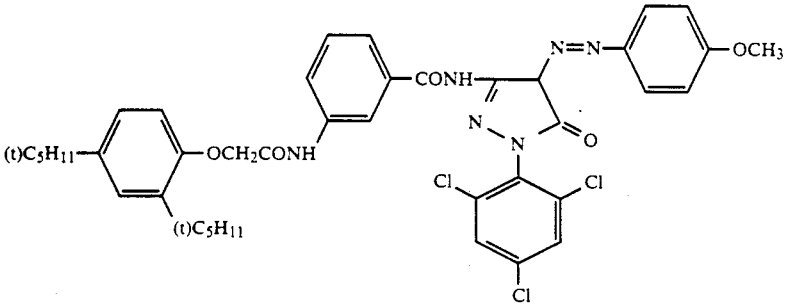

-continued
C-(15)
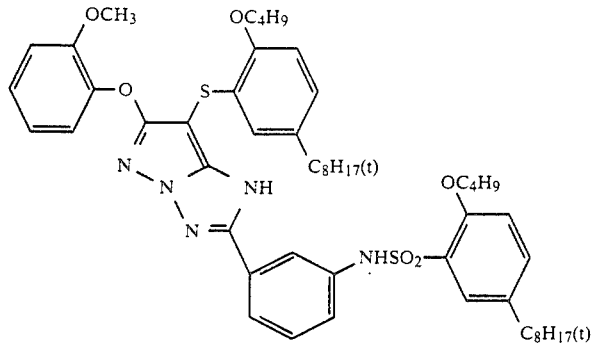
C-(16)
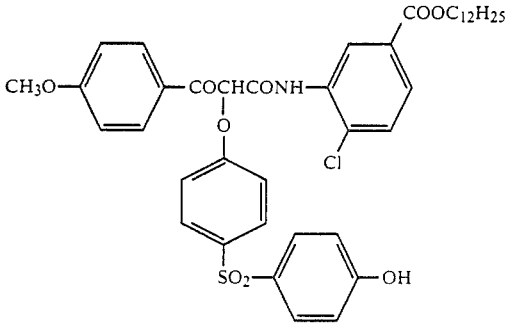
C-(17)
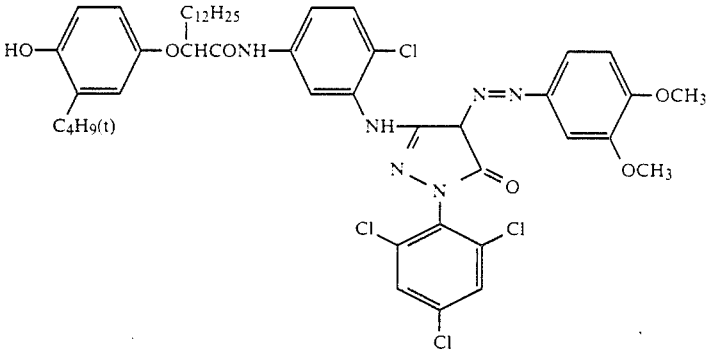
C-(18)
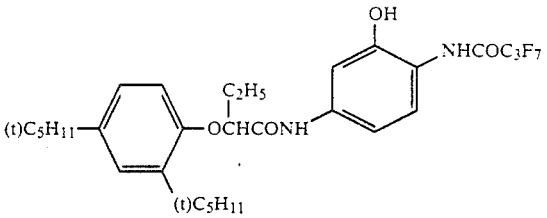
C-(19)
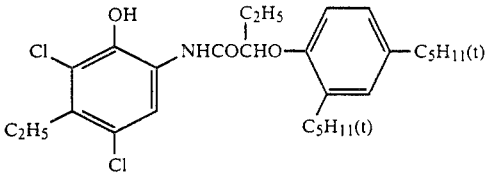
C-(20)
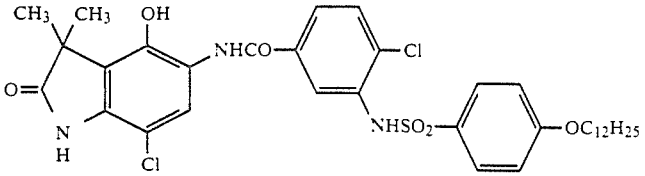

-continued
C-(21)
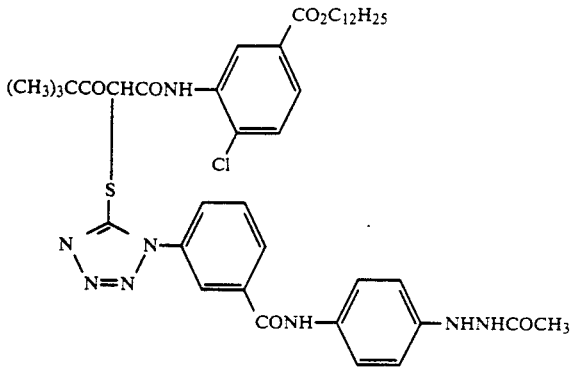
C-(22)
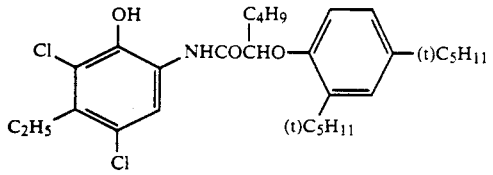
C-(23)
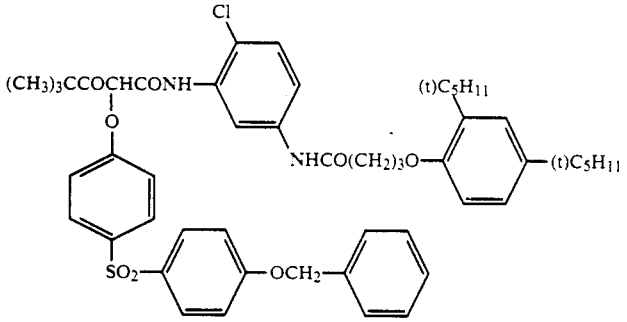
C-(24)
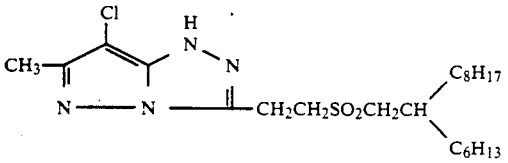
C-(25)
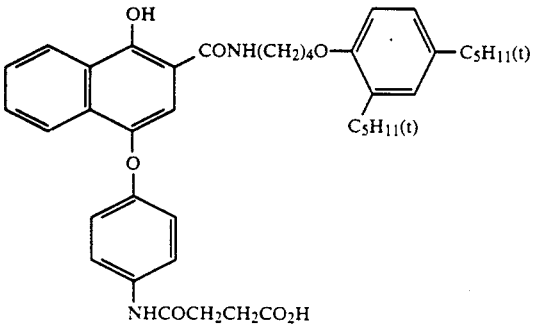

-continued

C-(26)

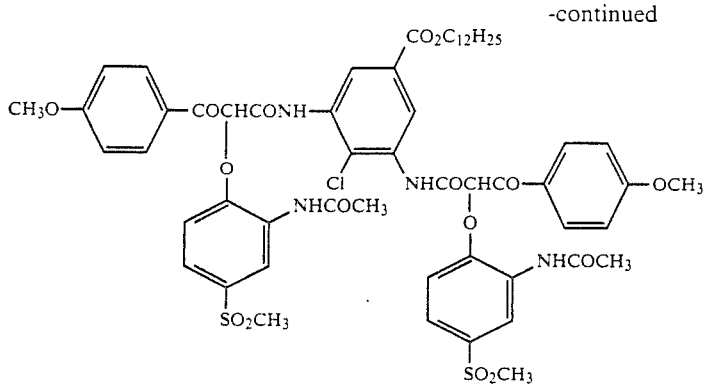

C-(27)

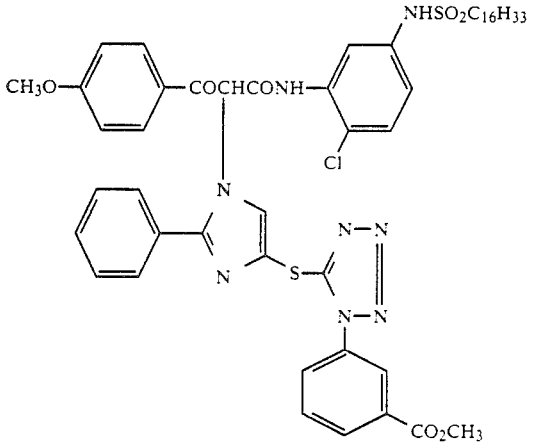

C-(28)

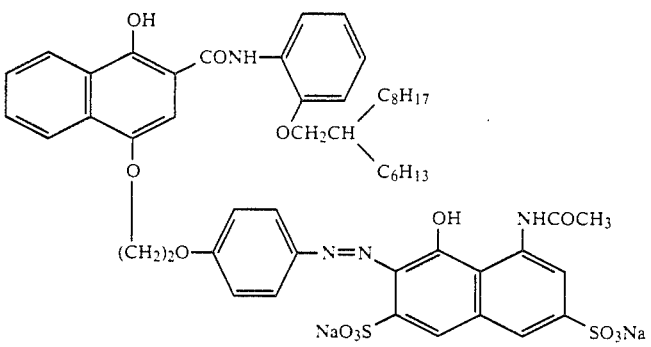

Typical examples of the yellow couplers usable in the present invention include oil-protecting type acylacetamide couplers. Examples are described in U.S. Pat. Nos. 2,407,210, 2,875,057 and 3,265,506. The 2-equivalent yellow couplers are preferably used in the present invention. Typical examples include yellow couplers of oxygen atom elimination group described in U.S. Pat. Nos. 3,408,194, 3,447,928, 3,933,501 and 4,022,620; and yellow couplers of nitrogen atom elimination type described in J. P. KOKOKU NO. 55-10739, U.S. Pat. Nos. 4,401,752 and 4,326,024, RD 18053 (April, 1979) British Patent No. 1,425,020, West German Unexamined Patent Publication Nos. 2,219,917, 2,261,361, 2,329,587 and 2,433,812. α-Pivaloylaceto-anilide-type couplers are superior in the fastness of the dyes, particularly fastness to light. On the other hand, α-benzoylacetoanilide-type couplers give a high coloring density.

The magenta couplers usable in the present invention include those of oil-protecting type such as indazolone couplers, cyanoacetyl couplers and preferably 5-pyrazolone couplers and pyrazoloazole couplers such as pyrazolotriazole couplers. Among the 5-pyrazolone couplers, those having an arylamino substituent or acylamino substituent at the 3-position are preferred from the viewpoint of the hue and color density. Typical examples are described in U.S. Pat. Nos. 2,311,082, 2,343,703, 2,600,788, 2,908,573, 3,062,653, 3,152,896 and 3,936,015. The removable groups of the 2-equivalent 5-pyrazolone couplers are preferably nitrogen atom-elimination groups described in U.S. Pat. No. 4,310,619 or arylthio groups described in U.S. Pat. No. 4,351,897. 5-Pyrazolone couplers having a ballast group described in European Patent No. 73,636 give a high color density.

The pyrazoloazole couplers include, for example, pyrazolobenzimidazoles described in U.S. Pat. No. 3,369,879 and preferably pyrazolo[5,1-c][1,2,4]triazoles described in U.S. Pat. No. 3,725,067, pyrazolotetrazoles described in Research Disclosure 24220 (June, 1984) and pyrazolopyrazoles described in Research Disclosure 24230 (June, 1984). Imidazo[1,2-b]pyrazoles described in European Patent No. 119,741 are preferred because of low yellow sub-absorption and light fastness of the developed dye, and pyrazolo[1,5-b][1,2,4]triazole described in European Patent No. 119,860 is particularly preferred.

The cyan couplers usable in the present invention are oil-protecting type naphthol and phenol couplers. Typical examples of the naphthol couplers are those described in U.S. Pat. No. 2,474,293, preferably oxygen atom-elimination type 2-equivalent naphthol couplers described in U.S. Pat. Nos. 4,052,212, 4,146,396, 4,228,233 and 4,296,200. Examples of the phenol couplers are described in U.S. Pat. Nos. 2,369,929, 2,801,171, 2,772,162 and 2,895,826. Cyan couplers that are stable to moisture and temperature are preferably used in the present invention. Typical examples include phenolic cyan couplers having an alkyl group not lower than ethyl group at m-position of the phenol nucleus as described in U.S. Pat. No. 3,772,002, 2,5-diacylamino-substituted phenol couplers as described in U.S. Pat. Nos. 2,772,162, 3,758,308, 4,126,396, 4,334,011 and 4,327,173, West German Unexamined Patent Publication No. 3,329,729 and J. P. KOKAI NO. 59-166956, and phenol couplers having a phenylureido group position 2 and an acylamino group at position 5 as described in U.S. Pat. Nos. 3,446,622, 4,333,999, 4,451,559 and 4,427,767.

It is possible to additionally use a coupler in which the colored dye has an appropriate diffusibility to improve the graininess. Examples of such dye-diffusing couplers are magenta couplers described in U.S. Pat. No. 4,366,237 and British Patent No. .2,125,570, and yellow, magenta or cyan couplers described in European Patent No. 96,570 and West German Unexamined Patent Publication No. 3,234,533.

The dye-forming coupler or the above-described particular couplers may be a polymer not lower than the dimer. Typical examples of the polymerized dye-forming couplers are described in U.S. Pat. Nos. 3,451,820 and 4,080,211. Examples of the polymerized magenta couplers are described in British Patent No. 2,102,173 and U.S. Pat. No. 4,367,282.

Two or more couplers usable in the present invention can be contained in a single photosensitive layer in order to satisfy the properties required of the photosensitive material, or a compound can be contained in two or more different layers. The coupler is usually used in the form of a dispersion thereof in the above-described oil (high-boiling organic solvent), but it can be directly dispersed in the hydrophilic binder without using any oil.

The standard amount of the color coupler is in the range of 0.001 to 1 mol per mol of the photosensitive silver halide. It is preferably 0.01 to 0.5 mol for the yellow coupler, 0.003 to 0.3 mol for the magenta coupler and 0.002 to 0.3 mol for the cyan coupler.

The photographic photosensitive material used in the present invention is applied to an ordinary flexible support such as a plastic film (e.g. cellulose nitrate, cellulose acetate or polyethylene terephthalate film) or paper, or a rigid support such as a glass plate. The supports and the application methods are described in detail in Research Disclosure, Vol. 176, Item 17643, Paragraph XV (p. 27) and Paragraph XVI (p. 28) (December, 1978).

A reflective support is preferably used in the present invention. Such a support is used for increasing the reflection and thereby making the color image formed on the silver halide emulsion layer vivid. The reflective supports include those prepared by coating a support with a hydrophobic resin in which a light-reflecting substance such as titanium oxide, zinc oxide, calcium carbonate or calcium sulfate is dispersed and those comprising a hydrophobic resin in which such a light-reflecting substance is dispersed.

By the process of the present invention, the color development can be remarkably improved and a sufficient $D_{max}$ can be obtained.

Further, delay of the development can be prevented even with a benzyl alcohol-free color developer.

EXAMPLES

The following Examples will further illustrate, but by no means limit, the present invention.

EXAMPLE 1

A multilayer color photographic paper composed of the following layers on a paper support laminated with polyethylene on both surfaces was prepared. The coating solutions were prepared as follows:

Coating solution for forming the first layer 27.2 ml of ethyl acetate and 8.2 g of a solvent (Solv-3) were added to a mixture of 19.1 g of yellow coupler (ExY), 4.4 g of color image stabilizer (Cpd-1) and 0.7 g of color image stabilizer (Cpd-7) to prepare a solution. The solution was dispersed in 185 ml of 10% aqueous gelatin solution containing 8 ml of 10% sodium dodecylbenzenesulfonate to prepare an emulsified dispersion. On the other hand, $2.0\times 19^{-4}$ mol, per mol of silver, of a blue-sensitive sensitizing dye was added to a silver chlorobromide emulsion (having average cubic grain size of 0.88$\mu$, and coefficient of variation of grain size distribution of 0.08 and containing 0.2 molar % of silver bromide on the grain surface) and the mixture was subjected to the sulfur sensitization. The emulsified dispersion was mixed with the emulsion to prepare the first layer-forming solution having the composition shown below. Coating solutions for forming the second layer to the seventh layer were prepared in the same manner as above.

The spectral sensitizing dyes used in the respective layers were as follows:

Blue-sensitive emulsion layer:

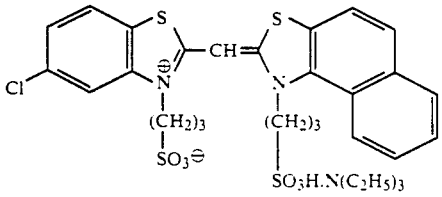

-continued

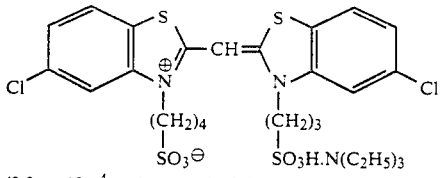

(2.0 × $10^{-4}$ mol per mol of the silver halide)

Green-senstive emulsion layer

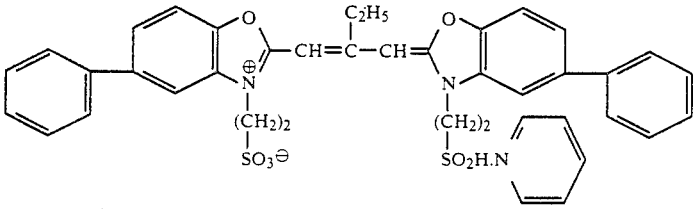

(4.0 × $10^{-4}$ mol per mol of the silver halide)

and

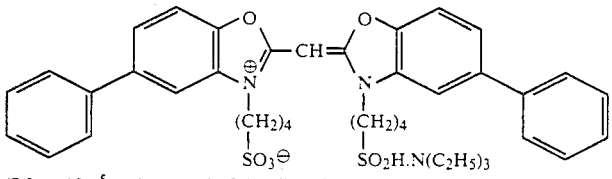

(7.0 × $10^{-5}$ mol per mol of the silver halide)

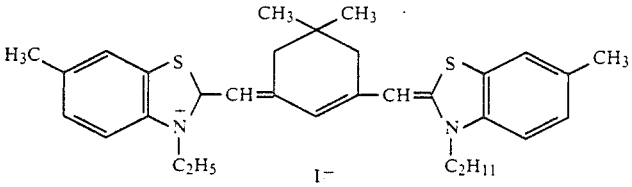

(0.9 × $10^{-4}$ mol per mol of the silver halide)

In the red-sensitive emulsion layer, $2.6\times10^{-3}$ mol, per mol of the silver halide, of the following compound was used.

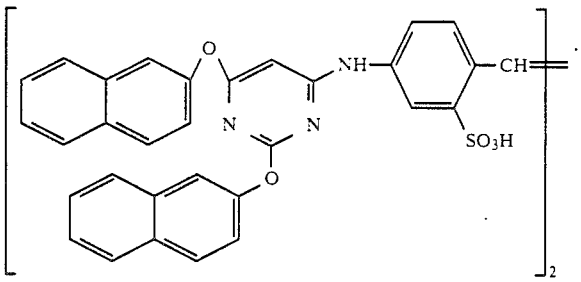

$8.5\times10^{-5}$ mol, $7.7\times10^{-4}$ mol and $2.5\times10^{-4}$ mol, per mol of the silver halide, of 1-(5-methylureido-phenyl)-5-mercaptotetrazole were added to the blue-sensitive emulsion layer, green-sensitive emulsion layer and red-sensitive emulsion layer, respectively.

The following dyes were added to the emulsion layer in order to prevent the irradiation:

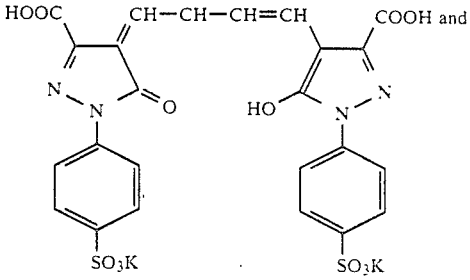

-continued

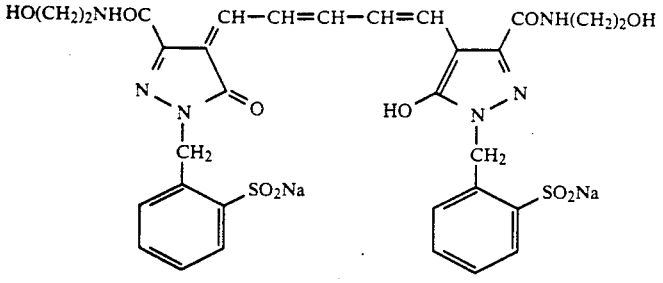

Layer structure

The compositions of the respective layers are shown below. The numerals indicate the amounts of the applied components (g/m$^2$). The amount of the silver halide emulsion applied is shown in terms of silver.

Support

Polyethylene-laminated paper

[containing a white pigment ($TiO_2$) and blue dye (ultramarine) in the polyethylene applied to the first layer-side]

| | |
|---|---|
| The first layer (blue-sensitive layer) | |
| Silver chlorobromide emulsion | 0.30 |
| Gelatin | 1.86 |
| Yellow coupler (ExY) | 0.82 |
| Color image stabilizer (Cpd-1) | 0.19 |
| Solvent (Solv-3) | 0.35 |
| Color image stabilizer (Cpd-7) | 0.06 |
| The second layer (color mixing-inhibiting layer) | |
| Gelatin | 0.99 |
| Color-mixing inhibitor (Cpd-5) | 0.08 |
| Solvent (Solv-1) | 0.16 |
| Solvent (Solv-4) | 0.08 |
| The third layer (green-sensitive layer) | |
| Silver chlorobromide emulsion [mixture of cubic grains having average grain size of 0.55μ and those of 0.39μ in a molar ratio of 1:3 (in terms af Ag)] having coefficients of variation of grain size distribution of 0.10 and 0.08 and containing 0.8 molar % of silver bromide on the grain surface | 0.12 |
| Gelatin | 1.24 |
| Magenta coupler (ExM) | 0.27 |
| Color image stabilizer (Cpd-3) | 0.15 |
| Color image stabilizer (Cpd-8) | 0.02 |
| Color image stabilizer (Cpd-9) | 0.03 |
| Solvent (Solv-2) | 0.54 |
| The fourth layer (U. V-absorption layer) | |
| Gelatin | 1.58 |
| U. V. absorber (UV-1) | 0.47 |
| Color-mixing inhibitor (Cpd-5) | 0.05 |
| Solvent (Solv-5) | 0.24 |
| The fifth layer (red-sensitive layer) | |
| Silver chlorobromide emulsion [mixture of cubic grains having average grain size of 0.58μ and those of 0.45μ in a molar ratio of 1:4 (in terms of Ag)] having coefficients of variation of grain size distribution of 0.09 and 0.11, respectively, and containing 0.6 molar % of AgBr in a part of the grain surface | 0.23 |
| Gelatin | 1.34 |
| Cyan coupler (ExC) | 0.32 |
| Color image stabilizer (Cpd-6) | 0.17 |
| Color image stabilizer (Cpd-10) | 0.04 |
| Color image stabilizer (Cpd-7) | 0.40 |
| Solvent (Solv-6) | 0.15 |
| The sixth layer (U. V. absorption layer) | |
| Gelatin | 0.53 |
| U. V. absorber (UV-1) | 0.16 |
| Color-mixing inhibitor (Cpd-5) | 0.02 |
| Solvent (Solv-5) | 0.08 |
| The seventh layer (protective layer) | |
| Gelatin | 1.33 |
| Acryl-modified polyvinyl alcohol copolymer (degree of modification: 17%)) | 0.17 |
| Liquid paraffin | 0.03 |

-continued
(ExY) Yellow coupler
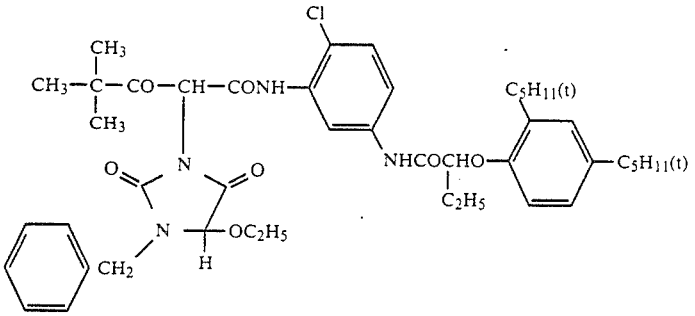
(ExM) Magenta coupler
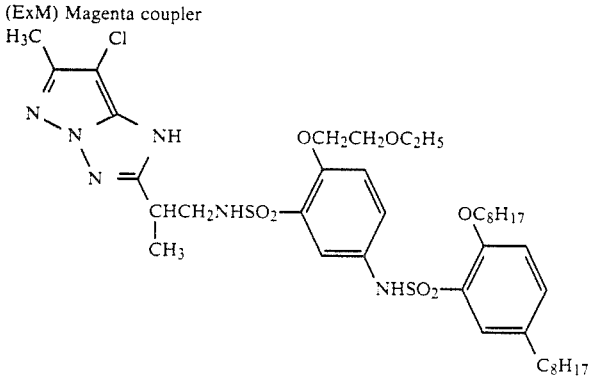
(ExC) Cyan coupler
(Mixture of the following compounds in a weight ratio of 2:4:4)
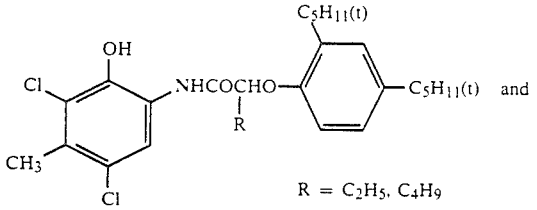
R = $C_2H_5$, $C_4H_9$
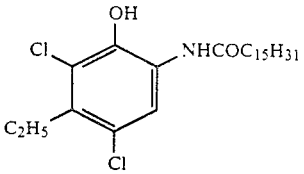
(Cpd-1) Color image stabilizer
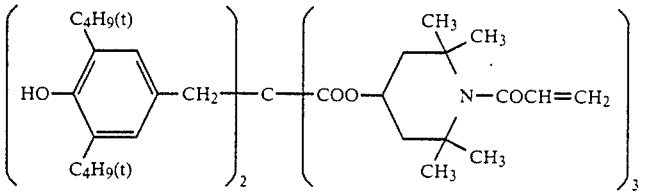
(Cpd-3) Color image stabilizer
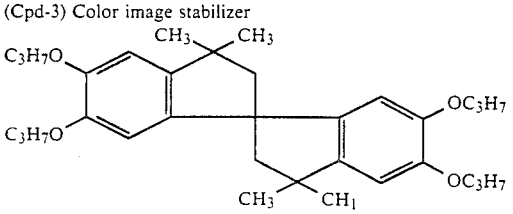
(Cpd-5) Color-mixing inhibitor -continued
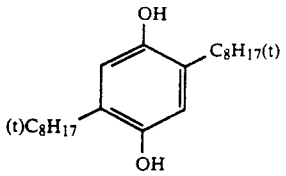
(Cpd-6) Color image stabilizer
(Mixture of the following compounds in a weight ratio of 2:4:4)
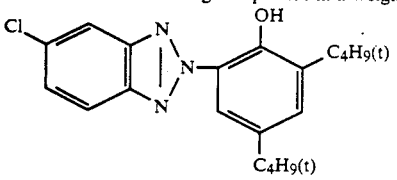
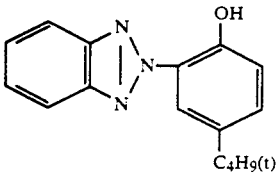
and
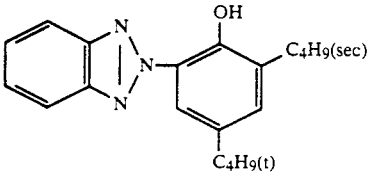
(Cpd-7) Color image stabilizer
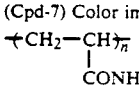
Average molecular weight: 60,000
(Cpd-8) Color image stabilizer
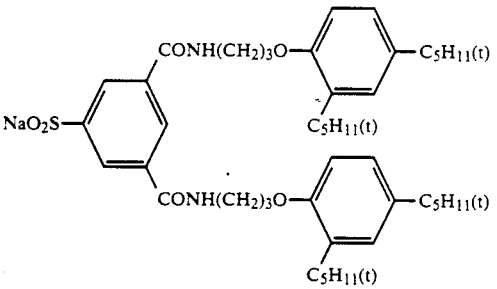
(Cpd-9) Color image stabilizer
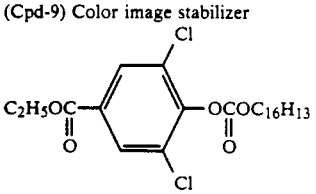
(Cpd-10) Color image stabilizer
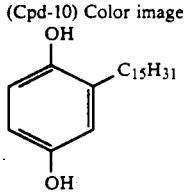
(UV-1) U. V. absorber
(Mixture of the following components in a weight ratio of 4:2:4)

-continued

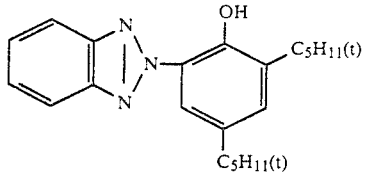

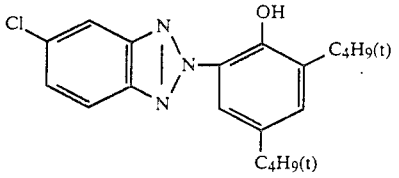

and

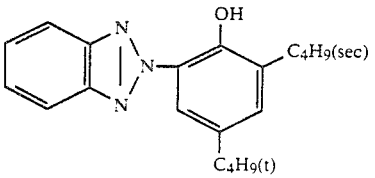

(Solv-1) Solvent

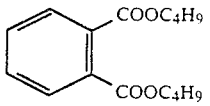

(Solv-2) Solvent
(Mixture of the following compounds in a volume ratio of 2:1)

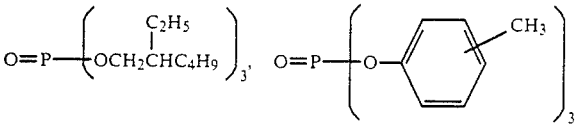

(Solv-3) Solvent
$O{=}P{+}C_9H_{19}(iso))_3$ (Solv-4) Solvent

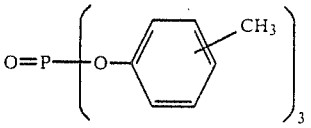

(Solv-5) Solvent
$COOC_8H_{17}$
|
$(CH_2)_8$
|
$COOC_8H_{17}$ (Solv-6) Solvent

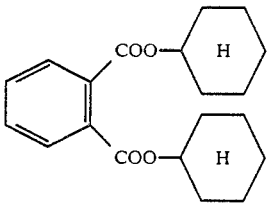

The silver halide photographic photosensitive material thus obtained will be referred to as Sample 1-A.

Five samples (Samples 1-B to 1-F) were prepared by adding a nondiffusible color developing agent of the present invention represented by the general formula (I) and shown in Table 1 in an amount equimolar to the yellow coupler in the first layer (blue-sensitive layer), in an amount equimolar to the magenta coupler in the third layer (green-sensitive layer) and in an amount equimolar to the cyan coupler in the fifth layer (red-sensitive layer).

TABLE 1

| Sample No. | Nondiffusible color developing agent |
|---|---|
| 1-A (Comparative) | — |
| 1-B (Present invention) | (1) |
| 1-C (Present invention) | (4) |
| 1-D (Present invention) | (7) |
| 1-E (Present invention) | (11) |
| 1-F (Present invention) | (28) |

The above photosensitive materials were exposed through an optical wedge and then processed with the following three kinds of color developers in the following steps:

| Processing step | Temperature | Time |
|---|---|---|
| Color development | 35° C. | 20 sec |
| Bleach fixing | 30 to 36° C. | 45 sec |
| Stabilization (1) | 30 to 37° C. | 20 sec |
| Stabilization (2) | 30 to 37° C. | 20 sec |
| Stabilization (3) | 30 to 37° C. | 20 sec |
| Stabilization (4) | 30 to 37° C. | 30 sec |
| Drying | 70 to 85° C. | 60 sec |

(The four tanks in the stabilization steps (4) to (1) were of the counter current system)

The compositions of the processing solutions were as shown below:

| Color developer (a) | | |
|---|---|---|
| water | | 800 ml |
| Ethylenediaminetetraacetic acid | | 2.0 g |
| Benzyl alcohol | | 15 ml |
| Triethanolamine | | 8.0 g |
| Sodium chloride | | 1.4 g |
| Potassium carbonate | | 25 g |
| N-Ethyl-N-(β-methanesulfonamidoethyl)-3-methyl-4-aminoaniline sulfate | | 5.0 g |
| N,N-Diethylhydroxylamine | | 4.2 g |
| 5,6-Dihydroxybenzene-1,2,4-trisulfonic acid | | 0.3 g |
| Fluorescent whitening agent (4,4'-diaminostilbene) | | 2.0 g |
| Water | ad | 1000 ml |
| pH (25° C.) | | 10.10 |

Color developer (b)

The same composition as that of the Color developer (a) except that it was free from benzyl alcohol.

Color developer (c)

The same composition as that of the Color developer (b) except that it was free from N-ethyl-N-(β-methanesulfonamidoethyl)-3-methyl-4-aminoaniline sulfate.

| Bleach fixing solution | | |
|---|---|---|
| Water | | 400 ml |
| Ammonium thiosulfate (700 g/l) | | 100 ml |
| Sodium sulfite | | 18 g |
| Ferric (III) ammonium ethylenediaminetetraacetate $2H_2O$ | | 55 g |
| Disodium ethylenediaminetetraacetate | | 3 g |
| Glacial acetic acid | | 8 g |
| Water | ad | 1000 ml |
| pH (25° C.) | | 5.5 |
| **Stabilizer** | | |
| Formalin (37%) | | 0.1 g |
| Formalin/sulfurous acid adduct | | 0.7 g |
| 5-Chloro-2-methyl-4-isothiazoline-3-on | | 0.02 g |
| 2-Methyl-4-isothiazoline-3-on | | 0.01 g |
| Copper sulfate | | 0.005 g |

-continued

| | | |
|---|---|---|
| Water | ad | 1000 ml |
| pH (25° C.) | | 4.0 |

The maximum color density of the blue-sensitive layer and fog density of each of the samples 1-A to 1-F processed with the above-described three kinds of the color developers were determined with a Macbeth densitometer to obtain the results shown in Table 2. The maximum color density and fog density of the green-sensitive layer were also determined to obtain the results shown in Table 3.

TABLE 2

| Sample No. | Color developer (a) Fog | Color developer (a) Maximum density | Color developer (b) Fog | Color developer (b) Maximum density | Color developer (c) Fog | Color developer (c) Maximum density |
|---|---|---|---|---|---|---|
| 1-A | 0.12 | 2.20 | 0.09 | 1.70 | 0.09 | 0.09 |
| 1-B | 0.12 | 2.44 | 0.09 | 2.43 | 0.09 | 0.10 |
| 1-C | 0.12 | 2.44 | 0.09 | 2.44 | 0.09 | 0.11 |
| 1-D | 0.12 | 2.43 | 0.09 | 2.40 | 0.09 | 0.09 |
| 1-E | 0.12 | 2.45 | 0.09 | 2.43 | 0.09 | 0.10 |
| 1-F | 0.12 | 2.44 | 0.09 | 2.41 | 0.09 | 0.09 |

The numerals surrounded by indicate the results of the present invention.

TABLE 3

| Sample No. | Color developer (a) Fog | Color developer (a) Maximum density | Color developer (b) Fog | Color developer (b) Maximum density | Color developer (c) Fog | Color developer (c) Maximum density |
|---|---|---|---|---|---|---|
| 1-A | 0.12 | 2.30 | 0.08 | 2.20 | 0.08 | 0.08 |
| 1-B | 0.12 | 2.55 | 0.08 | 2.51 | 0.08 | 0.09 |
| 1-C | 0.12 | 2.55 | 0.08 | 2.52 | 0.08 | 0.09 |
| 1-D | 0.12 | 2.56 | 0.08 | 2.54 | 0.08 | 0.09 |
| 1-E | 0.12 | 2.54 | 0.08 | 2.51 | 0.08 | 0.10 |
| 1-F | 0.12 | 2.55 | 0.08 | 2.51 | 0.08 | 0.09 |

The numerals surrounded by indicate the results of the present invention.

It is apparent from Tables 2 and 3 that when the blue-sensitive layer and green-sensitive layer are processed with the color developing agent (b), sufficient maximum color density can be obtained in the Samples 1-B to 1-F of the present invention by the acceleration effect which was higher than that of the Comparative Sample 1-A, though the fog density in the former was substantially equal to that in the latter. When the Color developer (a) containing benzyl alcohol was used, sufficient maximum color density of the sample containing the nondiffusible developing agent could be obtained with the color developer containing benzyl alcohol. When the Color developer (C) containing neither benzyl alcohol nor color developing agent was used, coloring was substantially impossible. Thus when the photosensitive material of the present invention containing the nondiffusible color developing agent is processed with the benzyl alcohol-free color developing agent (b), the best results are obtained, namely, a sufficient acceleration effect can be observed with only a slight fogging and, particularly, a quite high maximum density can be obtained.

EXAMPLE 2

Six samples (Samples 2-A1 to 2-A6 or Samples 2-B1 to 2-B6) and solvent-free samples (Sample 2-A7 or 2-B7) were prepared in the same manner as that of Example 1 except that the solvent (Solv-3) used for dispersing the yellow coupler in the first layer (blue-sensitive layer) was replaced with a solvent shown in Table 4. They were processed with the color developer (b) in the same manner as that in Example 1 and the maximum color density and fog density in the blue-sensitive layer were determined in the same manner as that of Example 1. The results are shown in Table 4.

TABLE 4

| Sample No. | Solvent | Fog density | Maximum color density |
|---|---|---|---|
| 1-A (Comparative) | Solv-3 (S-10) | 0.09 | 1.70 |
| 2-A1 (Comparative) | S-12 | 0.09 | 1.71 |
| 2-A2 (Comparative) | S-16 | 0.10 | 1.84 |
| 2-A3 (Comparative) | S-25 | 0.09 | 1.75 |
| 2-A4 (Comparative) | S-53 | 0.09 | 1.68 |
| 2-A5 (Comparative) | S-54 | 0.09 | 1.69 |
| 2-A6 (Comparative) | S-55 | 0.09 | 1.70 |
| 2-A7 (Comparative) | — | 0.09 | 1.39 |
| 1-B (Present invention) | Solv-3 (S-10) | 0.09 | 2.43 |
| 2-B1 (Present invention) | S-12 | 0.09 | 2.43 |
| 2-B2 (Present invention) | S-16 | 0.10 | 2.45 |
| 2-B3 (Present invention) | S-25 | 0.09 | 2.20 |
| 2-B4 (Present invention) | S-53 | 0.09 | 2.41 |
| 2-B5 (Present invention) | S-54 | 0.09 | 2.42 |
| 2-B6 (Present invention) | S-55 | 0.09 | 2.44 |
| 2-B7 (Present invention) | — | 0.09 | 2.11 |

It is apparent from Table 4 that when the nondiffusible color developing agent of the present invention was used (Samples 1-B and 2-B1 to 2-B6), the acceleration effect was observed irrespective of the kind of the solvent used. However, the effect of Sample 2-B3, in which S-25 was used for the dispersion, is slightly poorer.

EXAMPLE 3

The same samples as those of Examples 1 and 2 were processed with the following three kinds of color developers, respectively, according to the following steps in the manner similar to that employed in Examples 1 and 2, and the maximum color density and fog density in the blue-sensitive layer were determined. The results obtained are the same as those obtained in Examples 1 and 2.

| Processing step | Temperature | Time |
|---|---|---|
| Color development | 35° C. | 20 sec. |
| Bleach-fixing | 35° C. | 45 sec. |
| Water washing (1) | 35° C. | 30 sec. |
| Water washing (2) | 35° C. | 30 sec. |
| Water washing (3) | 35° C. | 30 sec. |
| Drying | 75° C. | 60 sec. |

(The three tanks in the water washing steps (3) to (1) were of the counter current system.)

| Color developer (A) | | |
|---|---|---|
| Water | | 800 ml |
| Ethylenediamine-N,N,N'-,N'-tetramethylene-phosphonic acid | | 3.0 g |
| Benzyl alcohol | | 15 ml |
| Triethanolamine | | 8.0 g |
| Sodium chloride | | 1.4 g |
| Potassium carbonate | | 25 g |
| N-ethyl-N-(β-methanesulfonamidoethyl)-3-methyl-4-aminoaniline sulfate | | 5.0 g |
| N,N-bis(carboxymethyl)hydrazine | | 5.0 g |
| Fluorescent whitening agent (trade name "WHITEX 4" produced by Sumitomo Chemical Co., Ltd.) | | 1.08 |
| Water | ad. | 1000 ml |

-continued

| Color developer (A) | |
|---|---|
| pH (25° C.) | 10.05 |

Color developer (B)

The same composition as that of the Color developer (A) except that it was free from benzyl alcohol.

Color developer (C)

The same composition as that of the Color developer (B) except that it was free from N-ethyl-N-(β-methanesulfonamidoethyl)-3-methyl-4-aminoaniline sulfate.

| Bleach fixing solution | | |
|---|---|---|
| Water | | 700 ml |
| Ammonium thiosulfate (700 g/l) | | 100 ml |
| Sodium sulfite | | 18 g |
| Ferric (III) ammonium ethylenediaminetetraacetate $2H_2O$ | | 55 g |
| Disodium ethylenediaminetetraacetate | | 3 g |
| Ammonium bromide | | 40 g |
| Glacial acetic acid | | 8 g |
| Water | ad | 1000 ml |
| pH (25° C.) | | 5.5 |

Washing water

Tap water which has been treated with ion exchange resins in such that each content of calcium and magnesium in the water is reduced to not more than 3 ppm. The conductivity of the treated water was 5 μs/cm (25° C.)

What is claimed is:

1. A method for forming an image, which comprises processing a silver halide color photosensitive material comprising a nondiffusible coupler and a nondiffusible color developing agent on a support with a color developer containing a diffusible color developing agent comprising an aromatic primary amine, said nondiffusible color developing agent being represented by the formula (I)

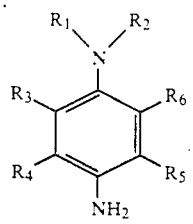

(I)

wherein $R_1$ and $R_2$ each represent a hydrogen atom, a straight chain or branched alkyl group, a cycloalkyl group or a straight chain or branched alkenyl group, or $R_1$ and $R_2$ may form a heterocyclic group together with the nitrogen atom, $R_3$, $R_4$, $R_5$ and $R_6$ are substituents of the benzene ring, and are each independency selected from the group consisting of a hydrogen atom, halogen atom, alkyl group, alkenyl group, aryl group, alkoxy group, alkenoxy group, aryloxy group, alkylthio group, arylthio group, acyl group, acyloxy group, acylamino group, amino group, sulfonamido group, carbamoyl group, sulfamoyl group, alkoxycarbonyl group and aryloxycarbonyl group ($R_3$ and/or $R_6$ may form a five-membered or six-membered ring together with $R_1$ and- /or $R_2$), with the proviso that the number of total carbon atoms in $R_1$ to $R_6$ is 10 to 30 and wherein said diffusable color developing agent is represented by the formula (II);

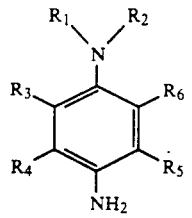

wherein $R_1$ to $R_6$ are defined hereinabove with the proviso that the number of total carbon atoms in $R_1$ to $R_6$ is 0 to 9.

2. A method of claim 1 wherein the nondiffusible color developing agent is incorporated into a high-boiling organic solvent together with the nondiffusible coupler.

3. A method of claim 1 wherein the nondiffusible coupler has a ballast group or is a polymerized coupler.

4. A method of claim 1 wherein the nondiffusible color developing agent is incorporated into an emulsion layer in an amount of 5 to 200 molar % relative to the nondiffusible coupler contained in the emulsion layer.

5. A method of claim 4 wherein the high-boiling organic solvent is represented by the following general formulae (A) to (E):

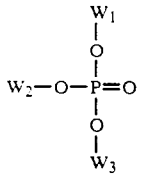

(A)

-continued $W_1—COO—W_2$ (B)

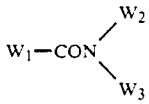

(C)

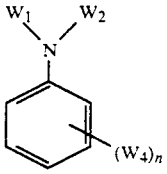

(D)

$W_1—O—W_2$ (E)

wherein $W_1$, $W_2$ and $W_3$ each represent a substituted or unsubstituted alkyl group, cycloalkyl group, alkenyl group, aryl group or heterocyclic group, $W_4$ represents $W_1$, $OW_1$ or $S\text{-}W_1$, n represents an integer of 1 to 5, when n is 2 or more, the $W_4$'s may be the same or different from one another, and $W_1$ and $W_2$ in the general formula (E) may form together a condensed ring.

6. A method of claim 5 wherein the high-boiling organic solvent have a dielectric constant of at least 5.0 at 25° C. and a viscosity of at least 20 cp at 25° C.

7. A method of claim 2 wherein a weight ratio of the high-boiling organic solvent to the nondiffusible coupler is 0.05 to 20.

8. A method of claim 1 wherein the color developer is substantially free from benzyl alcohol.

9. A method of claim 8 wherein the color developer contains benzyl alcohol in an amount of not more than 5 ml/l.

10. A method of claim 1 wherein the number of total carbon atoms in $R_1$ to $R_6$ of formula (II) is 3 to 8.

11. A method of claim 1 wherein the number of total carbon atoms in $R_1$ to $R_6$ of formula (II) is 3 to 7.

12. A method of claim 1 wherein the number of total carbon atoms in $R_1$ to $R_6$ of formula (I) is 13 to 30.

* * * * *